US010499695B2

(12) United States Patent
Wu

(10) Patent No.: US 10,499,695 B2
(45) Date of Patent: Dec. 10, 2019

(54) TRANSFORMABLE CLOTHING

(71) Applicant: Ping Wu, New York, NY (US)

(72) Inventor: Ping Wu, New York, NY (US)

( * ) Notice: Subject to any disclaimer, the term of this patent is extended or adjusted under 35 U.S.C. 154(b) by 55 days.

(21) Appl. No.: 15/786,363

(22) Filed: Oct. 17, 2017

(65) Prior Publication Data

US 2018/0035732 A1 Feb. 8, 2018

Related U.S. Application Data

(62) Division of application No. 14/163,736, filed on Jan. 24, 2014, now Pat. No. 9,826,787, which is a division of application No. 12/955,160, filed on Nov. 29, 2010, now abandoned.

(60) Provisional application No. 61/265,996, filed on Dec. 2, 2009.

(51) Int. Cl.

| | |
|---|---|
| ***A41D 15/00*** | (2006.01) |
| ***A41D 13/11*** | (2006.01) |
| ***A41D 19/00*** | (2006.01) |
| ***A41D 23/00*** | (2006.01) |
| ***A42B 1/20*** | (2006.01) |

(52) U.S. Cl.

CPC ..... *A41D 15/00* (2013.01); *A41D 13/11* (2013.01); *A41D 19/0017* (2013.01); *A41D 23/00* (2013.01); *A42B 1/206* (2013.01)

(58) Field of Classification Search

CPC ..... A41D 23/00; A41D 15/005; A41D 15/04; A41D 2023/00; A41D 2023/004

See application file for complete search history.

(56) References Cited

U.S. PATENT DOCUMENTS

| | | | |
|---|---|---|---|
| 807,628 | A | 12/1905 | Marks |
| 1,042,351 | A | 10/1912 | Johnstone |
| 1,167,058 | A | 1/1916 | Finberg |
| 1,285,917 | A | 11/1918 | Smith |
| 1,346,014 | A | 7/1920 | Garwitt |
| 1,399,523 | A | 12/1921 | Sable |
| 1,486,980 | A | 3/1924 | Macwilliam |
| D92,603 | S | 6/1934 | James |
| 2,019,248 | A | 10/1935 | Blumgardt |
| D126,586 | S | 4/1941 | Karsarda |

(Continued)

FOREIGN PATENT DOCUMENTS

| | | |
|---|---|---|
| CH | 697579 B1 * | 12/2008 |
| GB | 0 442 684 | 2/1936 |

*Primary Examiner* — Alissa J Tompkins
*Assistant Examiner* — Brieanna Szafran
(74) *Attorney, Agent, or Firm* — Foley & Lardner LLP

(57) ABSTRACT

A transformable article of clothing wearable by a person in a plurality of configurations. According to various embodiments, a transformable article of clothing comprises a central tubular portion coupled to a first member and a second member is configurable between a shawl and a scarf. In another embodiment, a transformable article of clothing comprises a first continuous loop coupled to a second continuous loop and is configurable among a hat, a hood, a scarf and a hand warmer. In yet another embodiment, an article of clothing comprises a mask portion and an ear muffler portion selectively retained on ears of the wearer. In still another embodiment, a transformable glove comprises a hand portion, a thumb portion, a first finger portion and a second finger portion with an opening in at least one of thumb and finger portions.

14 Claims, 18 Drawing Sheets

(56) References Cited

U.S. PATENT DOCUMENTS

| | | | | | |
|---|---|---|---|---|---|
| 2,413,319 | A | | 12/1946 | Golfieri | |
| 2,421,934 | A | | 6/1947 | Golfieri | |
| 2,603,788 | A | | 7/1952 | Page | |
| 2,717,390 | A | | 9/1955 | Houze | |
| 2,831,197 | A | | 4/1958 | Spells | |
| 3,036,450 | A | | 5/1962 | Holder | |
| 1,328,545 | A | | 4/1964 | O'Shea | |
| 3,144,660 | A | | 8/1964 | Romana | |
| 4,057,854 | A | | 11/1977 | Phelps, Sr. | |
| 4,062,062 | A | | 12/1977 | Basaldua | |
| 4,110,846 | A | | 9/1978 | Hernandez | |
| 4,476,587 | A | * | 10/1984 | Itoi | A41D 3/005 2/94 |
| 4,502,154 | A | * | 3/1985 | Itoi | A41D 3/00 2/108 |
| 4,559,647 | A | | 12/1985 | Smith et al. | |
| 4,641,380 | A | | 2/1987 | Epstein | |
| 4,706,304 | A | | 11/1987 | Jones | |
| 4,723,325 | A | | 2/1988 | Perry | |
| 4,870,707 | A | | 10/1989 | Hayes | |
| 4,980,923 | A | | 12/1990 | Kawamoto et al. | |
| 5,144,696 | A | | 9/1992 | Kahl | |
| 5,643,643 | A | | 7/1997 | Bernstein | |
| 5,822,800 | A | | 10/1998 | Anderson | |
| 5,850,634 | A | * | 12/1998 | Toombs | A41D 15/04 2/93 |
| 5,913,408 | A | | 6/1999 | Shanahan | |
| 6,032,292 | A | | 3/2000 | Wood et al. | |
| 6,145,131 | A | | 11/2000 | Huff | |
| 6,226,799 | B1 | | 5/2001 | Lane | |
| 6,640,342 | B2 | | 11/2003 | Dixon | |
| 6,665,876 | B1 | | 12/2003 | Newman | |
| 6,810,530 | B2 | | 11/2004 | Bryant, Sr. | |
| 7,007,309 | B1 | | 3/2006 | Mende | |
| D529,682 | S | | 10/2006 | Strong | |
| 7,231,670 | B2 | | 6/2007 | Chang | |
| 7,240,372 | B2 | | 7/2007 | Larson | |
| 7,467,422 | B2 | | 12/2008 | Bugarin | |
| D604,026 | S | | 11/2009 | Dugger | |
| 8,468,612 | B1 | | 6/2013 | Galloway | |
| D695,995 | S | | 12/2013 | Kim | |
| 9,138,025 | B1 | | 9/2015 | Lunsford | |
| 2002/0108164 | A1 | | 8/2002 | Dixon | |
| 2004/0181851 | A1 | | 9/2004 | Kanitz | |
| 2005/0039242 | A1 | | 2/2005 | Edmondson | |
| 2005/0177927 | A1 | | 8/2005 | Hettich | |
| 2006/0143796 | A1 | | 7/2006 | Bugarin | |
| 2006/0143797 | A1 | | 7/2006 | Waldman | |
| 2008/0115254 | A1 | | 5/2008 | Galkov | |
| 2008/0196140 | A1 | | 8/2008 | Mayerson et al. | |
| 2009/0126078 | A1 | | 5/2009 | Rashid | |
| 2011/0055999 | A1 | | 3/2011 | Su | |
| 2011/0126340 | A1 | | 6/2011 | Wu | |
| 2011/0191940 | A1 | | 8/2011 | Johnson | |
| 2012/0042432 | A1 | | 2/2012 | Tawfik | |
| 2012/0066812 | A1 | | 3/2012 | Alzate | |
| 2013/0326792 | A1 | | 12/2013 | Matos et al. | |

* cited by examiner

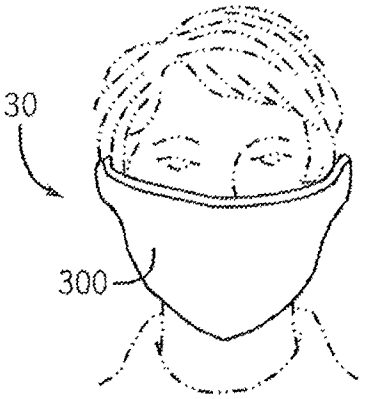
FIG. 11A
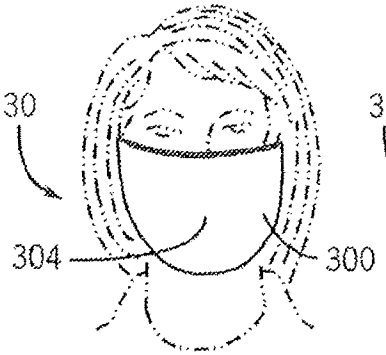
FIG. 11D
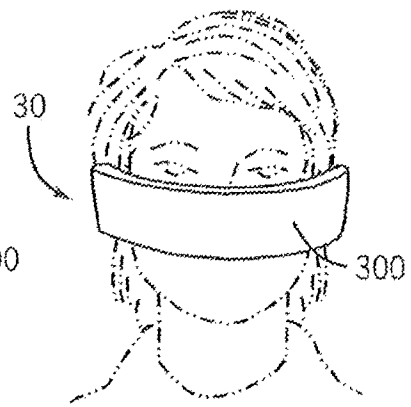
FIG. 11E
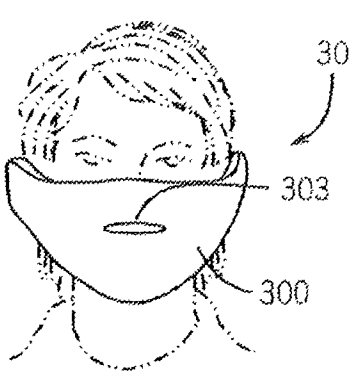
FIG. 11G
FIG. 11B
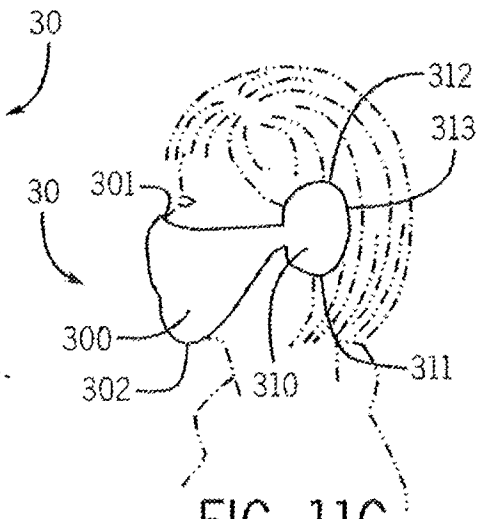
FIG. 11C
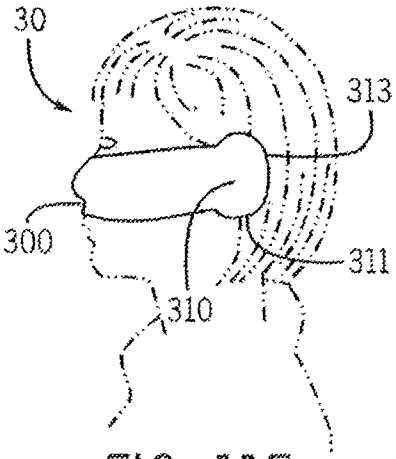
FIG. 11F
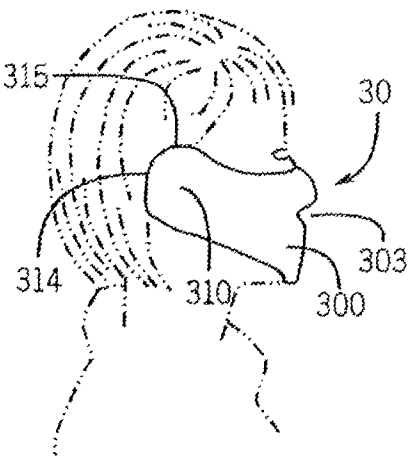
FIG. 11H

TRANSFORMABLE CLOTHING

CROSS REFERENCE TO RELATED APPLICATIONS

This application is a divisional of U.S. patent application Ser. No. 14/163,736, filed Jan. 24, 2014, which is a divisional of U.S. patent application Ser. No. 12/955,160, filed Nov. 29, 2010, which claims priority to U.S. Provisional Patent Application No. 61/265,996 filed Dec. 2, 2009. The contents of each application are hereby incorporated by reference in their entirety.

FIELD OF THE INVENTION

The present invention relates generally to the field of garments. More particularly, the present invention relates to garments wearable in a plurality of configurations.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Various conventional garments that may be worn to protect a person from ambient conductions or to achieve a particular appearance are well known in the art. For instance, numerous examples of scarves, hats, ear mufflers, masks, shawls and gloves are of course known in the art. Conventionally, these articles of clothing may be worn by a person and serve a single purpose for the wearer. By way of example, a hat is worn by a person to cover a portion of the head of the wearer. Various hats are known in the art intended for various conditions, including hats to protected a wearer from inclement conditions. Ear mufflers may worn to protect the ears of the wearer from cold temperatures. A conventional scarf may be worn about the neck and a portion of the face of a person to protect the neck and face of the wearer from cold temperatures and/or wind when outdoors. A shawl can be placed over the shoulders and a portion of the torso and arms of the wearer.

Various adaptable garments are also known. For example, a number of examples of a jacket or coat with a hood that is selectively receivable on the head of a wearer are known. Additionally, various articles of clothing have been developed that may be selectively reversed by a wearer in order to expose different surfaces, which may be of different colors and/or textures. Still other articles of clothing may include detachable components. For example, various coats with detachable sleeves and hats with detachable masks are known. Other articles of clothing may include portions that may be folded, zipped, buttoned or otherwise manipulated with respect to the article to provide greater or lesser body coverage depending on ambient conditions or the preferences of the wearer.

SUMMARY

Various embodiments of the present invention comprise transformable clothing that may be selectively configured by a wearer. Embodiments of the transformable garments include a transformable article of clothing comprising a central fabric portion. The central fabric portion defines a tubular member having a longitudinal length, the tubular member selectively reversible between a first configuration, where a first face substantially defines the external surface of the tubular member, and a reversed configuration, where the first face substantially defines the internal surface of tubular member. The transformable article of clothing further comprises a first fabric member and a second fabric member. The first fabric member includes a first portion coupled to the first face along at least a portion of the longitudinal length, and the second fabric member includes a second portion coupled to the first face along at least a portion of the longitudinal length. In the first configuration, the first fabric member and the second fabric member each extend from face of the tubular member. In the reversed configuration, the tubular member is configured to receive the first fabric member and the second fabric member.

In another set of embodiments, a transformable accessory is configurable as a hat and a scarf for a wearer. The transformable accessory comprises a first continuous loop defining a first opening and a second opening substantially opposite the first opening. The first continuous loop is configured to be selectively received about the neck of a wearer, with the neck extending through the first opening and the second opening. The transformable accessory further comprises a second continuous loop extending through the first opening and the second opening and received by the first continuous loop. The second continuous loop defines a third opening, and the second continuous loop is configured to be selectively received about at least a portion of the head of the wearer. The first continuous loop is wearable as a scarf, and the second continuous loop is simultaneously wearable as a hat.

In still another set of embodiments, a transformable accessory is wearable on the head of a person. The transformable accessory comprises a hat portion having a periphery, the periphery defining an opening at a first end of the hat portion, a closed end terminating substantially opposite the opening and configured to receive a portion the head of the wearer and a lateral portion attached to the periphery and extending from the periphery distal from the closed end. The transformable accessory further comprises a lower portion having a first end coupled to the hat portion and a second end substantially opposite the first end. The second end is selectively engageable with one of the hat portion and a portion of the wearer. The transformable accessory is selectively wearable in a first configuration and a second configuration.

In another set of embodiments, a transformable glove is configured to be worn on the hand of a person. The transformable glove comprises a wrist portion having an open first end configured to receive the hand of the wearer and a second end opposite the first end. The wrist portion is configured to surround at least a portion of the wrist of the wearer. A hand portion is attached at the second end and is sized to cover the palm and back of the hand of the wearer. The hand portion includes a thumb portion opening configured to receive the thumb of the wearer. The transformable glove further comprises a first finger portion opening configured to receive at least one finger of the wearer and a second finger portion opening configured to receive the remaining fingers of the wearer. A thumb portion is attached at the thumb portion opening and is configured to cover the thumb of the wearer The first finger portion is attached at the first finger portion opening and is configured to cover at least one finger of the wearer. The second finger portion is attached at the second finger portion opening and configured to cover the remaining fingers of the wearer. An exit is formed in at least one of the thumb portion, the first finger portion, and the second finger portion, with the at least one exit configured to allow selective extension of the respective at least one thumb and finger portions from the transformable glove.

In yet another set of embodiments, a combination garment for covering at least a portion of the face and ears of a wearer comprises a central portion. The central portion is configured to extend from a location forward of the ears of a wearer and across the face of the wearer such that the central portion is configured to substantially covers the cheeks and at least a portion of the nose of the wearer and extend downwardly beyond the mouth to cover at least a portion of the chin of the wearer. The combination garment further comprises a pair of ear portions attached to the central portion. Each of the pair of ear portions is configured to substantially cover the external surface of each ear of the wearer. Each of the pair of ear portions includes an engagement portion that is configured to selectively wrap around the periphery of the helix portion of each ear of the wearer, thereby enabling selective attachment of the combination garment to the wearer.

In still another set of embodiments, a transformable scarf is configured to be worn about the neck of a wearer. The transformable scarf comprises a primary clothing member defining a first face and a second face opposite the first face. The primary clothing member is characterized by a length and a width shorter than the length. A collar portion is disposed along a portion of the length. The primary clothing member includes a plurality of openings through the first face and the second face and is disposed along a portion of at least one of the length and the width. The transformable scarf further comprises a secondary clothing member that is selectively receivable by the plurality of openings such that a first portion of the secondary clothing member is disposed over a portion of the first face and a second portion of the secondary clothing member is disposed over a portion of the second face. The primary clothing member is wearable about the neck of the wearer These and other features of the invention, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

FIG. 11A is a front view of a first look of an article of clothing and constructed in accordance with yet another embodiment of the present invention, FIG. 11B is a front view of a second look of the article of clothing of FIG. 11A, FIG. 11C is a side view showing the second look of FIG. 11B, FIG. 11D is a front view of a third look of the article of clothing of FIG. 11A, FIG. 11E is a front view of a fourth look of the article of clothing of FIG. 11A, FIG. 11F is a side view showing the fourth look of FIG. 11E, FIG. 11G is a front view of a fifth look of the article of clothing of FIG. 11A, and FIG. 11H is a side view showing the fifth look of FIG. 11G;

DETAILED DESCRIPTION OF VARIOUS EMBODIMENTS

Figure 1A:
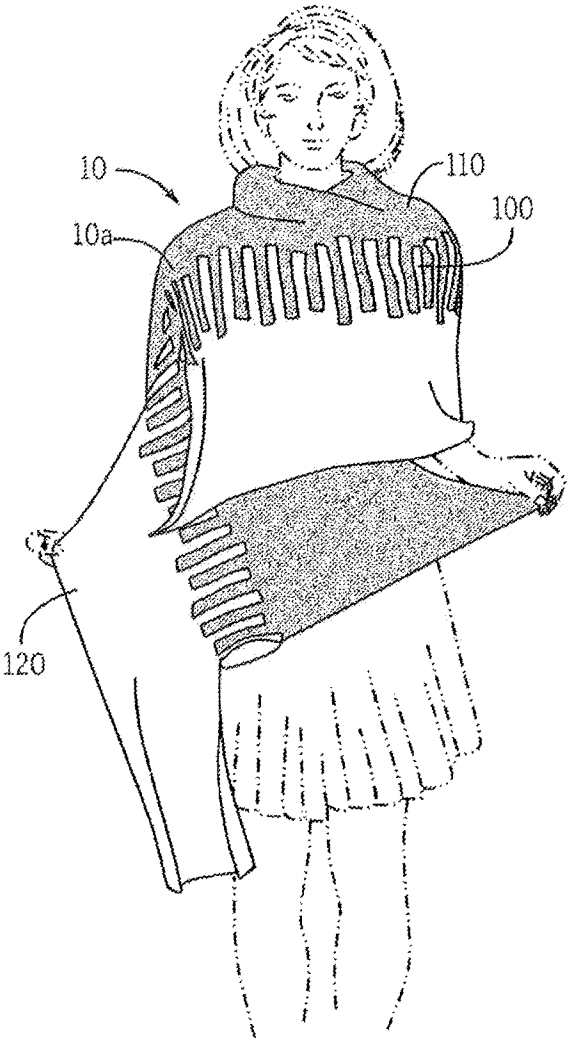
FIG. 1A is front view of a transformable article of clothing worn in a first configuration constructed in accordance with an embodiment of the present invention.

FIGS. 1A-5 illustrate an transformable article of clothing 10 according to an embodiment of the present invention. The transformable article of clothing 10 depicted in FIGS. 1A-5 comprises an accessory that may be selectively configured such that the garment may be worn as a shawl in a first configuration and may be worn as a scarf in a second configuration. FIG. 1A depicts the transformable article of clothing 10 in an exemplary first configuration where a person may wear the garment as a shawl 10*a*. In this configuration, the transformable article of clothing 10 may take a generally rectangular form. As shown in FIG. 1A, the shawl 10*a* may be draped over the shoulders of the wearer and is proportioned to substantially cover the shoulders and at least a portion of the arms of the wearer. FIG. 1B depicts the transformable article of clothing 10 in an exemplary second configuration where a person may wear the same garment, after its reconfiguration, as a scarf 10*b*. In this configuration, the transformable article of clothing 10 may be of a generally elongated tube form. As shown in FIG. 1B, the scarf 10*b* may be wrapped about the neck of the wearer and may be of a length such that the ends of the scarf 10*b* extend downward over a portion of the torso of the wearer.

Figure 2A:
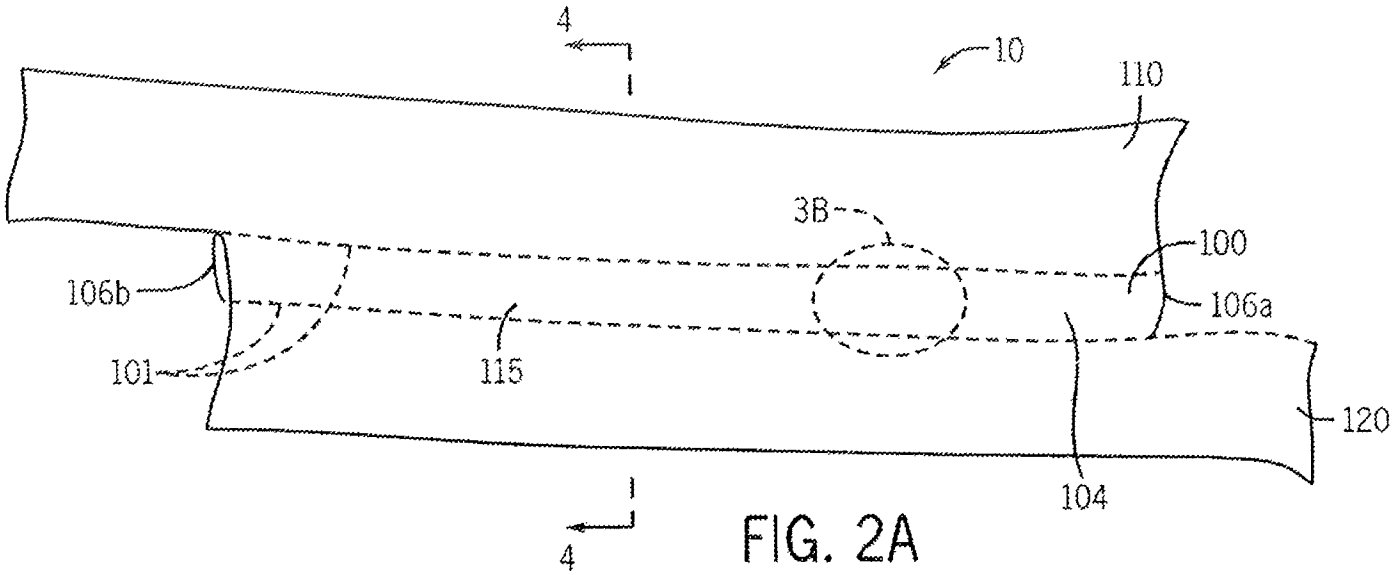
FIG. 2A is a top view of the transformable article of clothing of FIG. 1A in the configuration of FIG. 1A and shown fully extended.
Figure 2B:
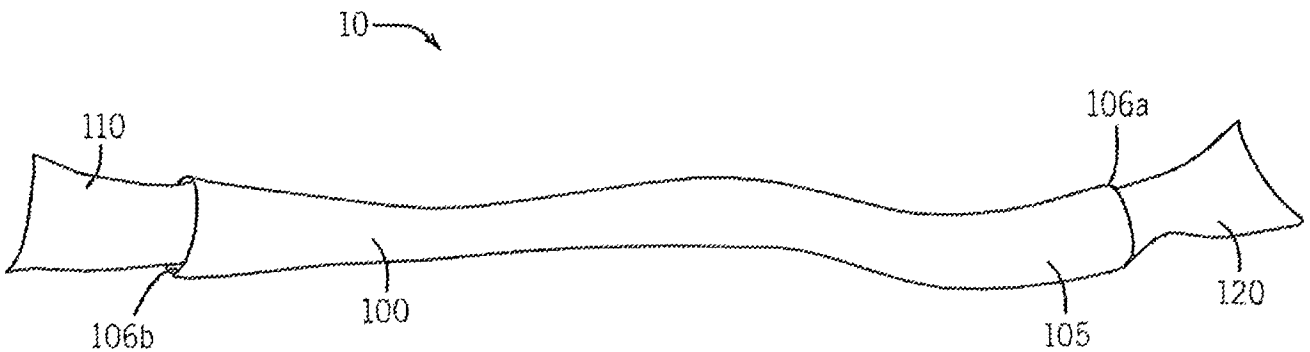
FIG. 2B is a top view of the transformable article of clothing of FIG. 2A in the configuration of FIG. 2B and shown fully extended.
Figure 4:
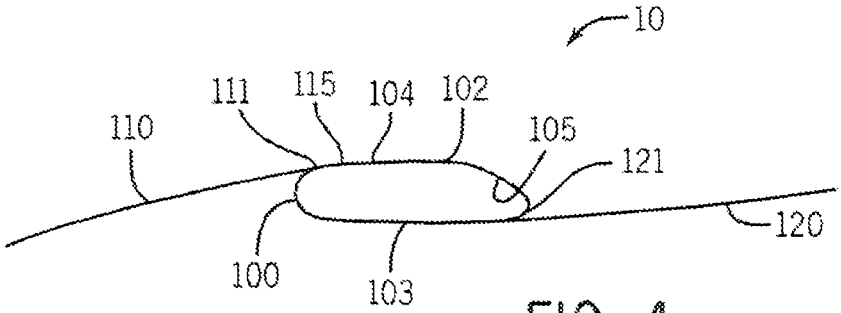
FIG. 4 is a cross-sectional view of the transformable article of clothing of FIG. 2A.

As shown in FIG. 2A, the transformable article of clothing 10 comprises a central portion 100, a first member 110 attached to the central portion 100 and a second member 120 coupled to the central portion 100. The central portion 100 includes a pair of lateral edges 101 extending the length of the central portion 100. As depicted in FIG. 4, the central portion 100 generally comprises a first surface 102 and a second surface 103 that are coupled along the lateral edges 101. As such, the central portion 100 forms an elongated tube having a first face 104 and a second face 105. As explained in detail below, depending on the configuration of the transformable article of clothing 10, the first face 104 or the second face 105 may define the external surface of the central portion 100. The central portion includes ends 106*a* and 106*b* disposed at each end of the tubular member.

Figure 3A:
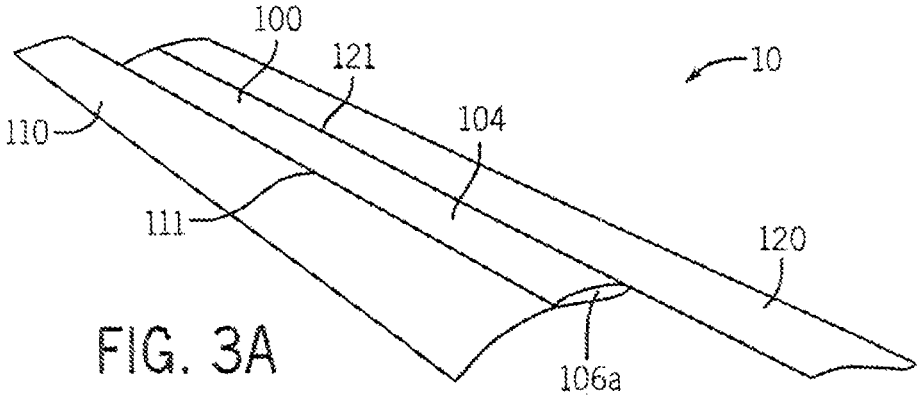
FIG. 3A is a perspective view of the transformable article of clothing of FIG. 1A in the configuration of FIG. 1A and shown fully extended.

FIG. 3A shows the first member 110 attached to the central portion 100 along one of the lateral edges 101 and the second member 120 attached to the central portion 100 along the other lateral edge 101. As shown, the first member 110 and the second member 120 are oppositely disposed on the central portion 100. That is, the first member 110 is attached to the central portion 100 at location on the tubular member that is offset about 180° from the location of attachment of the second member 120 to the central portion 100. However, other arrangements may be constructed where the first member 110 and the second member 120 are attached to the central portion 100 and separated by less than about 180°. Each of the first member 110 and the second member 120 extend outwardly from the central portion 100 to define a width of the transformable article of clothing 10. As shown in FIGS. 2A and 3, the first member 110 and the second member 120 may be of equal length and attached to the central portion 100 along the entire length of the central member. As depicted, the first member 110 and/or the second member 120 may of a greater length than the central portion 100, with a portion of the first member and/or the second member extending beyond one or more of the ends 106*a*/106*b*.

In the depicted embodiment, the central portion 100 is substantially formed by the first member 110 and the second member 120. With reference to FIGS. 2A and 4, each of the first member 110 and the second member 120 include an inner portion 115 medially disposed along a length of the transformable article of clothing 10. The inner portion 115 of the first member 110 is overlapped with the inner portion 115' of the second member 120 as shown in FIG. 4. The first member 110 includes a first edge 111 that defines the periphery of the inner portion 115. The second member 120 similarly includes a second edge 121 that defines the periphery of the inner portion 115' of the second member 120. The first member 110 is attached to the second member proximate the first edge 111. The second member 120 is also attached to the first member 110 proximate the second edge 121. Thus, the tubular member is formed with the inner portions 115 and 115' each forming about one half of the surface of the tubular member.

The transformable article of clothing 10 is not limited to the above described construction. For example, in other embodiments, the central portion 100 may be separately formed and then attached to the first member 110 and the second member 120. In other embodiments, the central portion 100 may be formed from one of the first member 110 or the second member 120 by overlapping one of the members onto itself and attaching the first/second edge 111/121 to the respective member to form a tubular member. The other member may then be attached to the tubular member. In still further embodiments, the first member 110 and the second member 120 comprise a single piece and an additional member is overlaid and attached to the single piece to form the tubular member. The additional member, for example, may comprise a narrow strip of material relative to the width of the single piece and may substantially define half the periphery of the tubular member. The additional member is attached to the single piece at a first location and a second location, for example, along substantially parallel edges defining the length of the additional member.

Figure 3B:
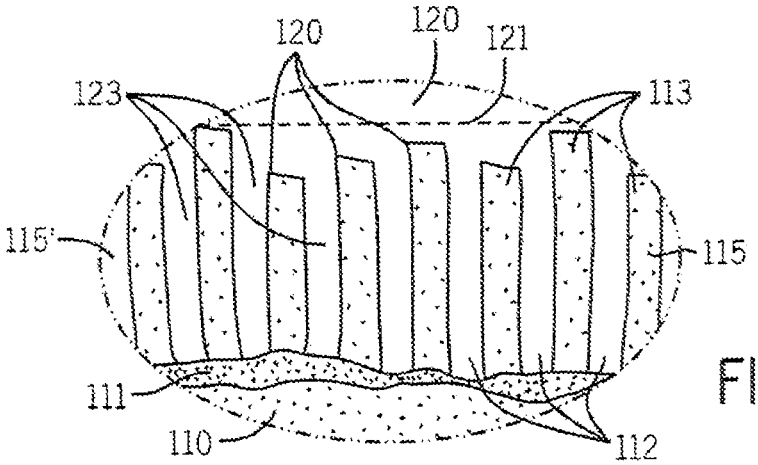
FIG. 3B is a close-up view of a portion of the transformable article of clothing of FIG. 3A.

As described above and as depicted in FIG. 4, the central portion 100 may be formed by overlapping a portion of the first member 110 and the second member 120. As shown in FIG. 3B, the first member 110 may include a first plurality of openings 112 disposed in the inner portion 115. The first plurality of openings 112 extend into the first member 110 from the first edge 111. As depicted, the first plurality of openings 112 are rectangular in shape and orientated substantially perpendicular to the first edge 111, however the first plurality of openings 112 may be angled in other embodiments and may take other forms, including curved and peaked shapes. Additionally, the first plurality of openings 112 are of substantially equal width and of equal length. In other embodiments, however, the first plurality of openings 112 may have a variety of widths and/or a variety of lengths. The first plurality of openings 112 define a first plurality of fingers 113. The length of the first plurality of fingers 113 may be varied with respect to each of the fingers. As such, the periphery of the first member 110 may be defined by the combination of the first plurality of openings 112 and the first plurality of fingers 113.

Similar to the first member 110, the second member 120 may include a second plurality of openings disposed in the inner portion 115'. The second plurality of openings extend into the second member 120 from the second edge 121. The second plurality of openings are shaped and orientated to substantially mate with the first plurality of fingers 113 and may be perpendicular to the second edge 121 or angled. As such, in the depicted embodiment, the second plurality of openings are rectangular and offset with respect to the first plurality of openings 112 such that the second plurality of openings align with the first plurality of fingers 113. The second plurality of openings are also of a width and length to receive the first plurality of fingers 113. The second plurality of openings define a second plurality of fingers. The second plurality of fingers are orientated and shaped to substantially mate with the first plurality of openings 112. Thus, the first plurality of openings 112 receive the second plurality of fingers.

Figure 1B:
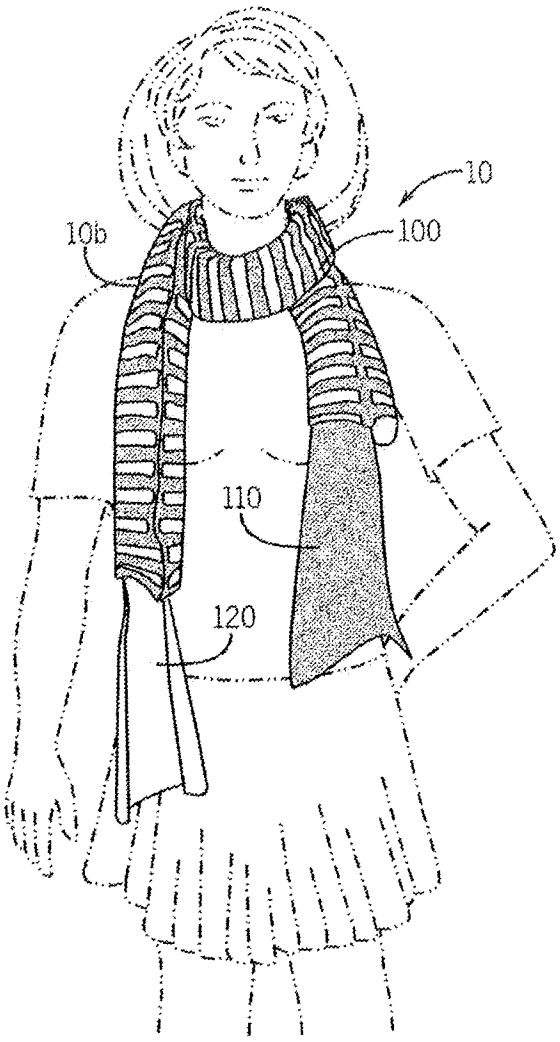
FIG. 1B is a front view of a transformable article of clothing of FIG. 1A worn in a second configuration.

The above described configuration of the first member 110 and the second member 120 forms an alternating and interlocking arrangement that may form at least a portion of the surface defining the tubular member. As depicted in FIGS. 1A and 1B, the first member 110 and the second member 120 may be of different colors and/or materials to form a visual or textural pattern over the central portion 100. In one embodiment, the visual pattern may simulate the look of a piano keyboard with alternating colors and the first plurality of fingers 113 and the second plurality of fingers 123 of variable length. In other embodiments, the central portion 100 may be constructed to depict different configurations and/or patterns.

The transformable article of clothing 10 may be constructed from a variety of materials, including materials typical of garments such as a sweater and accessory garments such as scarves, shawls, and hand warmers. In a particular embodiment, the first member 110 is constructed of a first material and the second member 120 is substantially constructed of a second material. The first material possesses different thermal characteristics than the second material such that the first material provides a greater or lesser degree of temperature control to the wearer relative to the second material. For example, relative to the second material, the first material may be of a greater density, use a smaller diameter yarn, comprise a tighter weave, possess a greater thickness, and combinations thereof. As such, when worn in the shawl configuration depicted in FIG. 1A, the first member 110 constructed of the first material is thinner and offers greater breathability relative to the second member 120 that is constructed of the second material. Thus, in the depicted orientation, the wearer is provided with additional thermal insulation about a portion of the arms and torso covered by the first member 110, while the neck and shoulders covered by the second member 120 are provided with relatively less thermal insulation from the transformable article of clothing 10. In response to changing ambient temperature conditions or other consideration, the transformable article of clothing 10 may be repositioned by the wearer such that second member 120 is orientated over a portion of the arm and torso and the first member 110 located about the neck and shoulders of the wearer, thereby reversing the thermal properties of the garment with respect to the wearer.

The transformable article of clothing 10 is selectively reconfigurable by a wearer or other person between the shawl 10*a* configuration depicted in FIG. 1A and the scarf 10*b* configuration of FIG. 1B. The transformable article of clothing 10 is changed from the shawl configuration to the scarf configuration by reversing the orientation of the central portion 100. That is, in the shawl configuration, the first face 104 of the tubular member is on the outside of the central portion 100 and the second face 105 forms the inner surface of the central portion 100. In the shawl configuration, the tubular member is substantially flat.

Figure 5:
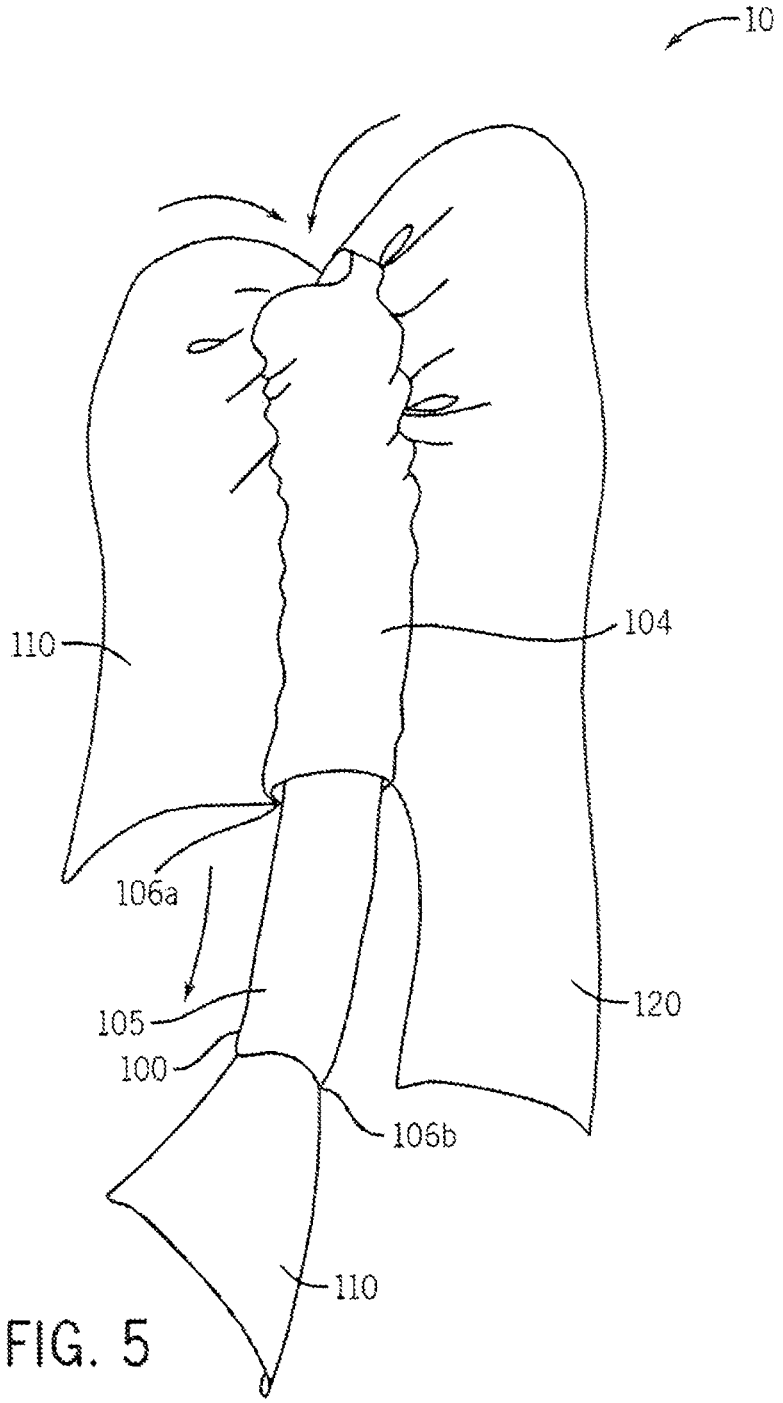
FIG. 5 is a view of the transformable article of clothing of FIG. 1A, in the process of being transformed from the first configuration to second configuration.

As depicted in FIG. 5, a wearer or other person may transform transformable article of clothing 10 to the scarf orientation by inserting a hand in one of the ends, for example the end 106*a*, extending the hand within the tubular member of the central portion 100, and grasping the opposite end 106*b* or a part of the central portion 100 proximate the opposite end 106*b*. The central portion 100 may be bunched as necessary to shorten its effective length to allow the opposite end 106*b* to be grasped as described. The opposite end 106*b* is then pulled through the tubular member and exits the end 106*a* that was initially entered by the hand. Thus, the tubular member of the central portion is turned "inside-out" and the transformable article of clothing 10 is in the scarf configuration. In this configuration the first face 104 forms the inner surface of the tubular member and the second face 105 is on the outside of the central portion. Because the first member 110 and the second member 120 are attached to central member along the first face 104, the first member 110 and the second member 120 are at least partially disposed within the tubular member in the scarf configuration. As shown in FIG. 1B, in embodiments where the first member 110 and/or the second member 120 have a length greater than the central portion 100, the first member 110 and/or the second member 120 may be selectively extend from the central portion 100. Alternatively, the first member 110 and/or the second member 120 may be stored within the tubular member of the central portion 100.

The transformable article of clothing 10 is selectively reconfigurable by a wearer or other person between the scarf configuration depicted in FIG. 1B and the shawl configuration of FIG. 1A by again reversing the central portion 100. A wearer or other person inserts a hand in one of the ends of the central portion 100, for example the end 106*a*, grasps a portion of the first member 110 and/or the second member 120 proximate the other end 106*b* and pulls the first member 110 and the second member 120 out from within the tubular portion, thereby reversing the central portion 100 and releasing the first member 110 and the second member 120. The first face 104 is reversed to the exterior of the central portion 100 and the transformable article of clothing 10 is returned to the shawl orientation.

Figure 6A:
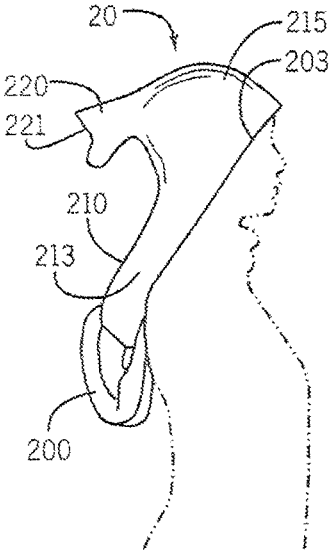
FIG. 6A is a side view of a transformable article of clothing worn in a first configuration constructed in accordance with another embodiment of the present invention.

FIGS. 6A-10 show a transformable article of clothing 20 according to another embodiment of the present invention. The transformable article of clothing 20 comprises an accessory that may be selectively configured to a plurality of configurations depicted in FIGS. 6A-6F, including a hat in a first configuration, a hat and scarf in a second configuration, a hat and a hand warmer in a third configuration and a hood in a fourth configuration. FIGS. 6A and 6B depict various examples of the transformable article of clothing 20 in the first configuration worn as a hat. FIGS. 6C and 6D show examples of the transformable article of clothing 20 in the second orientation worn as a hat or hood and a scarf. FIG. 6E shows an example of the transformable article of clothing 20 worn in the third orientation as a scarf and hand warmer. FIG. 6F shows an example of the transformable article of clothing 20 worn in the fourth orientation as a hood.

With reference to FIGS. 7-10, an embodiment of the transformable article of clothing 20 is depicted. The transformable article of clothing 20 generally comprises a first loop 200 and a second loop 210 coupled to the first loop 200. The first loop 200 comprises a scarf element selectively wearable about the neck of the wearer and may comprise a continuous loop of material defining an exterior surface 201 and a channel 202. The first loop 200 further defines a first opening 203 and a second opening 204 substantially opposite the first opening 203. The first loop 200 is curved and, in a particular embodiment, has a substantially circular shape.

The first loop 200 is configured to be passed over the head of the wearer and received about the neck of wearer. As such, the first loop 200 may be of a resilient construction where the channel 202, the first opening 203 and the second opening 204 are substantially sized to fit about the neck of the wearer and to stretch sufficiently in order to pass over the head of the wearer. Thus, the natural diameter of the channel 202 may be configured to be about the diameter of the neck of a human or slightly less than the diameter of the neck such that the first loop fits snugly about the neck of the wearer. However, in other embodiments, the channel 202 may have a natural diameter that is about the diameter of a human head and may be configured to fit loosely about the neck of the wearer and/or may include a drawstring or tightening element to reduce the diameter of the channel 202 to a smaller diameter that fits about the neck of the wearer. Additionally, the first loop 200 may be sized to have length, the distance between the first opening 203 and the second opening 204 to cover the neck of the wearer.

Figure 6B:
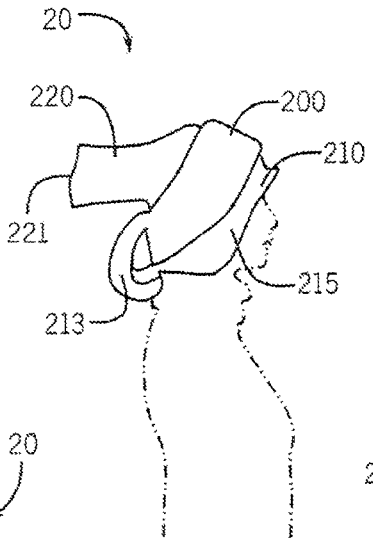
FIG. 6B is a side view of the transformable article of clothing of FIG. 6A worn in a second configuration.
Figure 6C:
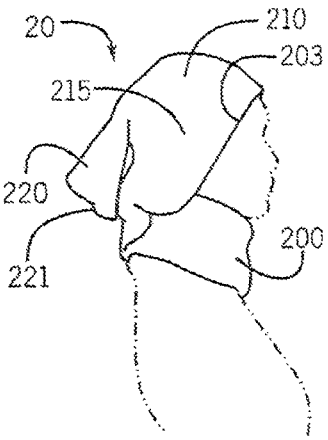
FIG. 6C is a side view of the transformable article of clothing of FIG. 6A worn in a third configuration.
Figure 6D:
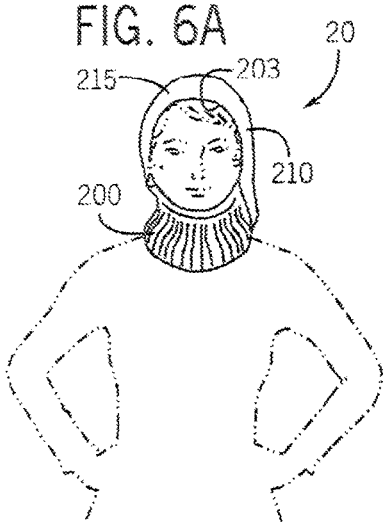
FIG. 6D is a front view of the transformable article of clothing of FIG. 6A worn in a fourth configuration.

As depicted in FIG. 6D, the length of the first loop 200 may be such that is extends below the neck. The first loop 200 may also be worn to extend over a portion of the face, such as the mouth or mouth and nose of the wearer. In a particular embodiment, the first loop 200 comprises a loop of material folded about its circumference doubling the material onto itself such that the length of the first loop is selectively adjustable by selecting the location of the fold.

Figure 7:
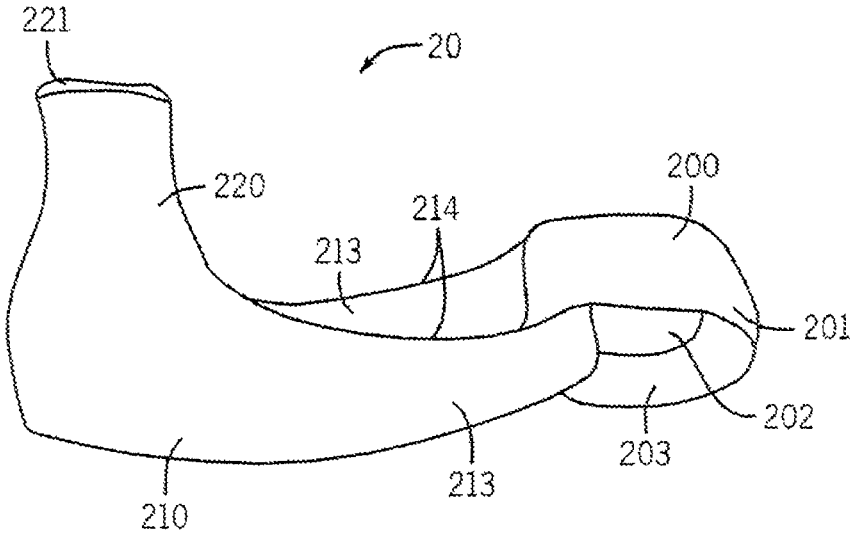
FIG. 7 is a first perspective view of the transformable article of clothing of FIG. 6A.
Figure 8:
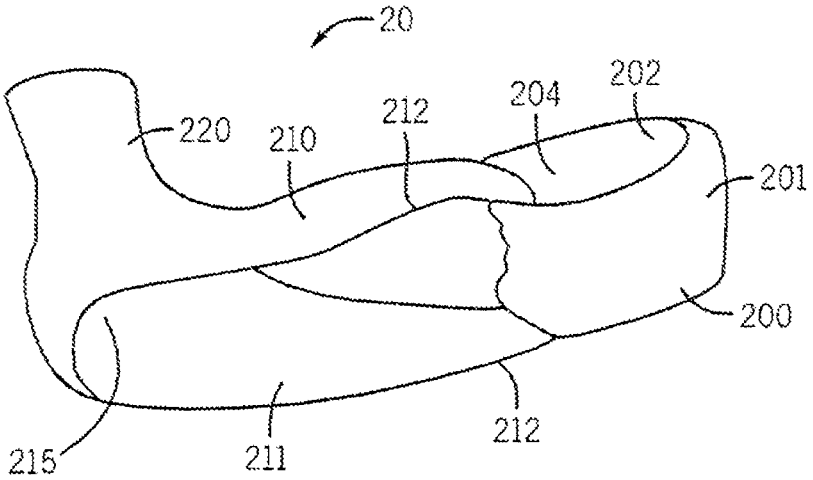
FIG. 8 is a second perspective view of the transformable article of clothing of FIG. 6A.
Figure 9:
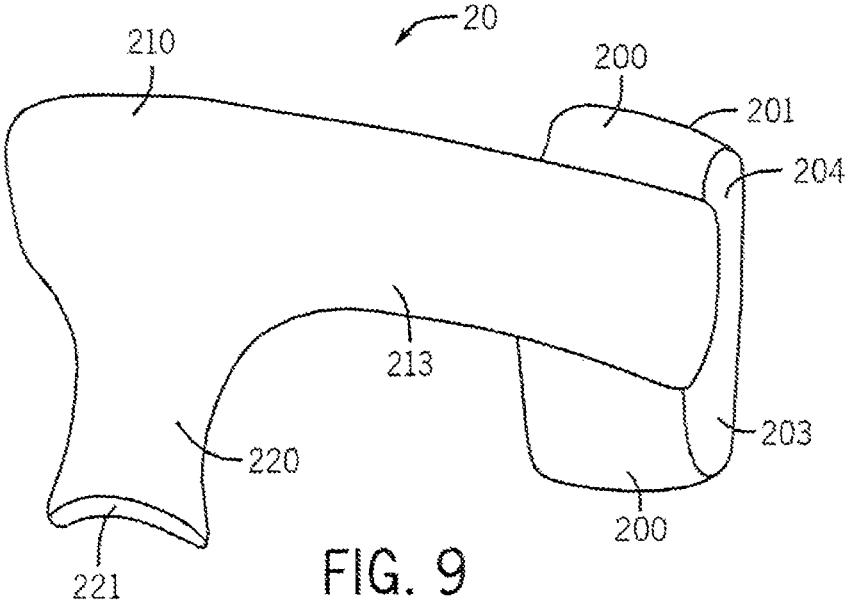
FIG. 9 is a side view of the transformable article of clothing of FIG. 6A.
Figure 10:
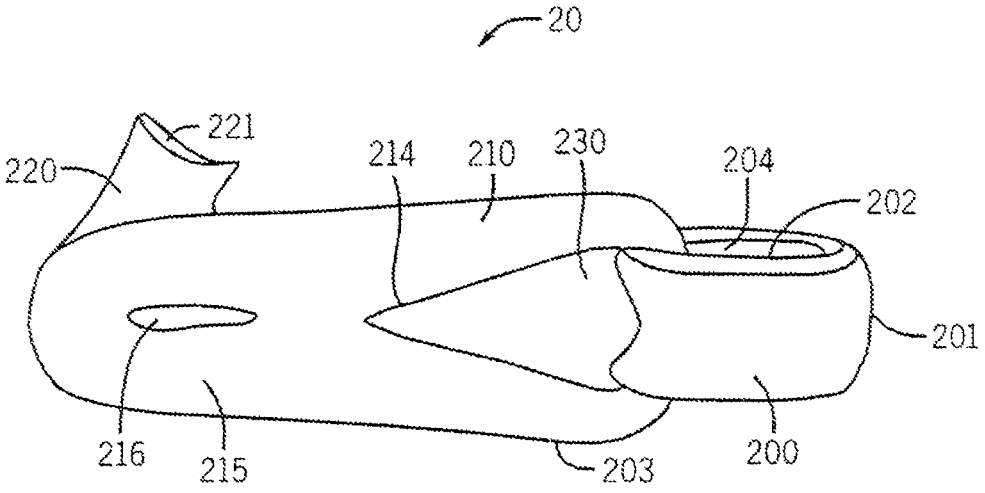
FIG. 10 is a front view of the transformable article of clothing of FIG. 6A.

The second loop 210 comprises a hat and hood element selectively wearable on the head of a wearer in various configurations and usable as a hand warmer in other configurations. The second loop 210 may be formed from an elongated continuous loop of material. In the depicted embodiment, the second loop 210 has a greater diameter than the first loop 200. The second loop 210 is captured by the first loop 200 similar to adjacent links of a chain. As shown in FIG. 7, for example, the second loop 210 passes through first opening 203 and the second opening 204 and a portion of the second loop 210 resides in the channel 202. The first loop 200 and the second loop 210 need not be fixedly attached relative to each other. Thus, first loop 200 and second loop 210 are selectively moveable relative to each other, subject to constraints of the interaction of the respective intertwined loops. The second loop 210 defines a third opening 211 along a front periphery 212 of a lateral surface 213 of the second loop 210. As shown in FIGS. 8 and 10, the lateral surface 213 may be of variable width. As depicted, a portion of the lateral surface 213 progressively widens extending from a rear periphery 214 as the second loop 210 extends distally from the first loop 200. A receiving region 215 is defined at an end of the second loop 210. The receiving region 215 is substantially dome shaped and configured to receive the head of the wearer, with the face of the wearer orientated in the third opening 211 as shown in FIG. 6A-6C for example.

Figure 6F:
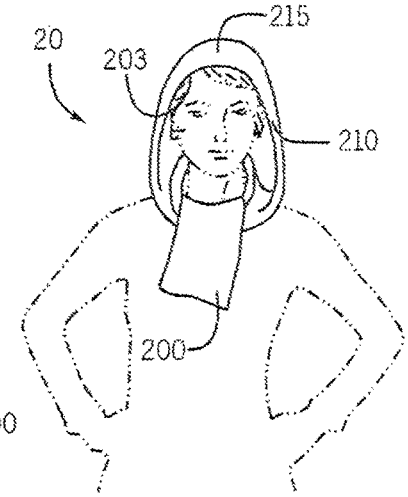
FIG. 6F is a front view of the transformable article of clothing of FIG. 6A worn in a sixth configuration.
Figure 6E:
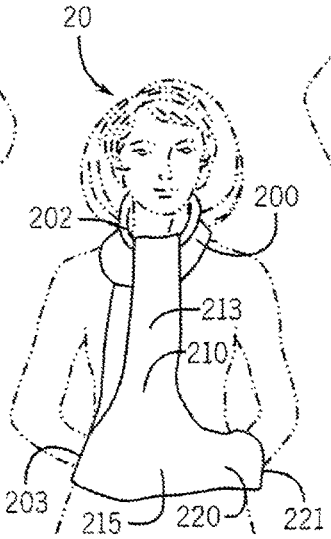
FIG. 6E is a front view of the transformable article of clothing of FIG. 6A worn in a fifth configuration.

The second loop 210 may further include a fourth opening 216. As shown in FIG. 10, the fourth opening 216 is located in the receiving region 215 substantially opposite the third opening 211. In the depicted embodiment, the fourth opening 216 is smaller than the third opening 211. As described in more detail below, the fourth opening 216 may receive a portion of the hair of the wearer when the transformable article of clothing 20 is worn in a configuration that includes a hat element such as in FIGS. 6A-6C. As also described below, the fourth opening 216 may receive the hand of the wearer when the transformable article of clothing 20 is worn in a configuration that includes a hand warmer element as shown in FIG. 6E.

As illustrated in FIG. 7, an arm 220 may be attached to the second loop 210 and extend from a portion of the second loop 210 opposite the third opening 211. In the depicted embodiment, the arm 220 is formed by the increasing width of the lateral surface 213 and forms a tubular portion terminating in a fifth opening 221. The arm 220, opposite the fifth opening 221, is located over the fourth opening 216. The fifth opening 221 may receive a portion of the hair of the wearer that is received through the fourth opening 216 when the transformable article of clothing 20 is worn in a configuration that includes a hat element such as in FIGS. 6A-6C. Additionally, the fifth opening 221 may receive the other hand of the wearer when the transformable article of clothing 20 is worn in a configuration that includes a hand warmer element as shown in FIG. 6E.

The second loop 210 may also include a sixth opening 230. As shown in FIG. 10, the sixth opening 230 is defined by the rear periphery 214 and is substantially opposite the third opening 211 and located below the fourth opening 216. As depicted, the sixth opening 230 is larger than the fourth opening 216. However, in other embodiments the fourth opening 216 and the sixth opening 230 may be of about equal size and in other embodiments the sixth opening 230 is larger than the fourth opening 216. The sixth opening 230 may define the opening by which the first loop 200 is interlocked with the second loop 210. In the depicted embodiment, the first loop 200 passes through and is captured by the sixth opening 230. However, in other embodiments, the first loop 200 and the second loop 210 may otherwise be coupled. The sixth opening 230 may be sized to fit about the neck of the wearer after the head of the wearer is passed through. As shown in FIG. 6F, the transformable article of clothing 20 may worn where second loop 210 is placed over the head of the wearer as a hood and the neck of the wearer extends through the sixth opening 230.

The transformable article of clothing 20 may be worn where a portion of the second loop 210 is received on the head of the wearer. As shown in FIGS. 6A-6D and 6F, the receiving region 215 of the second loop 210 covers the top portion of the head of the wearer. FIG. 6A shows a configuration where the second loop 210 is worn as a hat, with the lateral surfaces 213 falling down from the head of the wearer and covering the ears and draping over the shoulders of the wearer. The face of the wearer is accessible via the third opening 211. The first loop 200 may be located along the back of the wearer in the configuration depicted in FIG. 6A. A portion of the hair of the wearer, for example, a "pony tail," may received by the fourth opening 216, positioned within the arm 220 and may be extended through the fifth opening 221. FIG. 6B shows the transformable article of clothing 20 with the second loop 210 in substantially the configuration of FIG. 6A and the first loop 200 received on the head of the wearer and located over a portion of the second loop 210. In the configuration of FIG. 6B, the first loop 200 may be located to cover the ears of the wearer, providing an additional layer of material to cover and protect the ears from cold temperatures and or/wind.

FIG. 6C shows the transformable article of clothing 20 in a configuration where the second loop 210 is substantially in the configuration of FIGS. 6A and 6B and the first loop 200 is worn about the neck of the wearer. In this configuration, the first loop 200 serves as a scarf, protecting the neck of the wearer from cold temperature and/or wind. The first loop 200 is passed over the head of the wearer and the neck resides in the channel 202 that is best seen in FIGS. 7 and 8. FIG. 6D shows the transformable article of clothing 20 in a configuration where the first loop is in substantially the configuration of FIG. 6C and the second loop 210 is received over the head of the wearer as a hood. In the configuration of 6D, the head of the wearer passes through the sixth opening 230 and the head is received in the receiving region 215 of the second loop 210. FIG. 6F depicts a configuration where the second loop 210 is worn as a hood where the head of the wearer is passed through the sixth opening 230. In the configuration of 6F, the first loop 200 drapes from the front portion of neck of the wearer towards the chest.

FIG. 6E shows the transformable article of clothing 20 in a configuration where the first loop 200 is worn as a scarf and the second loop 210 serves as a hand warmer for the wearer. The neck of the wearer is received in the channel 202 of the first loop 200. The lateral surfaces 213 of the second loop 210 extend downward from the first loop 200 across the chest of the wearer. As shown, the receiving region 215 and the arm 220 may be located near the waist of the wearer. In this configuration, the wearer may insert one hand into the third opening 211 and the other hand in the fifth opening 221, protecting the hands of the wearer from cold temperatures and/or wind.

FIGS. 11A-14 show an article of clothing 30 according to another embodiment of the present invention. The article of clothing 30 comprises an accessory that may be worn as ear mufflers and simultaneously as a mask covering a portion of the face of the wearer. FIGS. 11A-11H depict various embodiments of the article of clothing 30. In each of the depicted embodiments, the article of clothing 30 includes a mask portion 300 and a pair of ear portions 310. As shown, for example, in FIGS. 11A, 11E and 11G, the configuration of the mask portion 300 may be varied to provide various levels of coverage to the face of the wearer. As described in more detail below, each of the pair of ear portions 310 is configured to selectively attach to the ears of the wearer and maintain the article of clothing 30 in a desired position over a portion of the face of the wearer.

Figure 12:
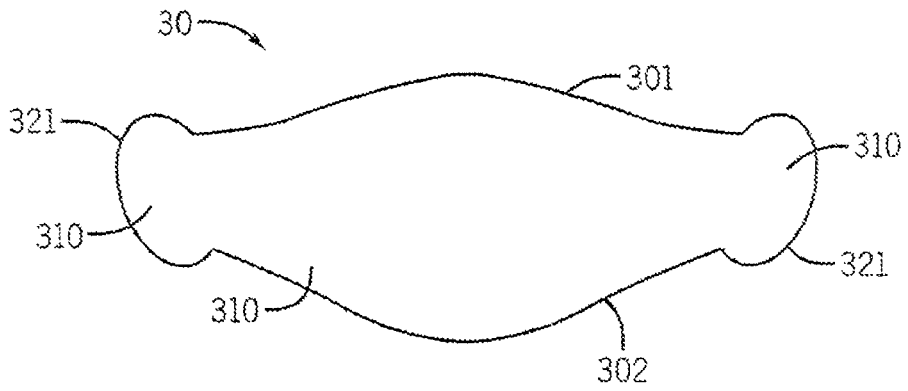
FIG. 12 is a front view of the article of clothing shown generally in FIGS. 11A-11G.

As shown in FIG. 12, the mask portion 300 defines an upper periphery 301 and a lower periphery 302. In the depicted embodiment, the upper periphery 301 and the lower periphery 302 define a substantially elongated diamond shape that is sized and shaped to fit over at least a portion of the nose, mouth, chin and cheeks of the wearer. The mask portion 300 extends from the pair of ear portions 310 located at opposite ends of the ear portions 310, where the mask portion 300 is relatively narrow, i.e. the distance between the upper periphery 301 and the lower periphery 302 is small. The mask portion 300 progressively grows in width toward the medial portion of the mask portion 300, where the distance between the upper periphery 301 and the lower periphery 302 is at its greatest.

In addition to the look discussed above, the mask portion 300 may comprise other looks For example, FIGS. 11A-11D depict an embodiment where an upper periphery 301 of the mask portion is substantially linear and stretches straight across the face of the wearer. The lower periphery 302 is curved or comprises angled segments to substantially follow the jaw line of the wearer. FIGS. 11E and 11F depict an embodiment where the mask portion 300 is of substantially constant width. Thus, the upper periphery 301 and the lower periphery 302 define a substantially constant distance between the pair of ear portions 310. In this embodiment, the width of the mask portion 300 is configured to cover only at least a portion of the nose of the wearer, but may alternatively be worn over the mouth of the wearer. FIGS. 11G and 11H depict an embodiment where the mask portion 300 is configured to cover a portion of the nose and the mouth of the wearer. In this embodiment, the lower periphery 302 is aligned with the lower portion of each of the pair of ear portions 310. The upper periphery 301 is aligned with the upper portion of each of the pair of ear portions 310.

In any of the embodiments depicted in FIGS. 11A-12 and described above, the mask portion 300 may include a mouth opening 303 as depicted in FIGS. 11G and 11H. The mouth opening 303 may comprise a horizontally orientated slit in the medial region of the mask portion 300. The mouth opening 303 is located in the mask portion 300 such that it would fall over the mouth of the wearer when worn.

In any of the embodiments depicted in FIGS. 11A-14 and as described above, the mask portion 300 may include a central portion 304 as depicted in FIG. 11D. The central portion 304 may be located proximate the mouth and/or nostril area of the wearer. The central portion 304 may be configured to allow for easier passage of air therethrough relative to mask portion 300 residing outside the central portion 304. As such, the central portion 304 facilitates the ability of the wearer to speak and/or breath through the mask portion 300. The central portion 304, for example, may comprise a plurality of openings or a thinner material, smaller diameter yarn, or less dense weave relative to the mask portion 300 outside the central portion 304, and combinations thereof.

Figure 13:
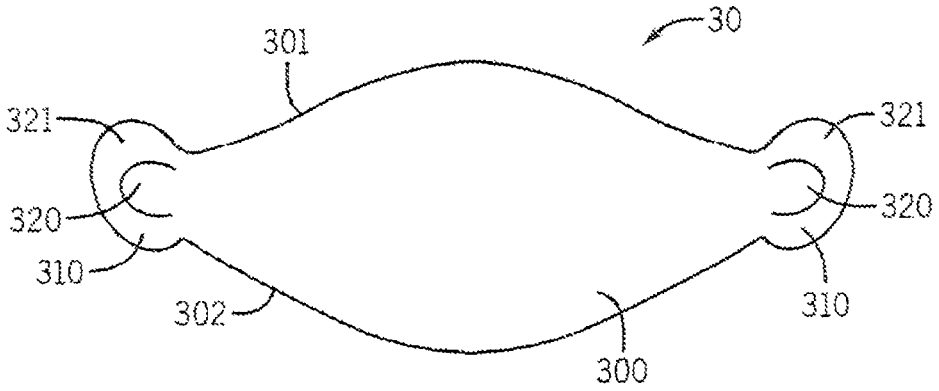
FIG. 13 is a rear view of the article of clothing of FIG. 12.
Figure 14:
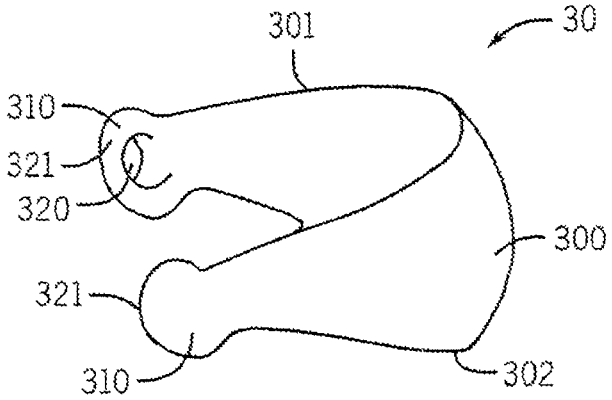
FIG. 14 is a perspective view of the article of clothing of FIG. 12.

With reference to FIGS. 13 and 14, the pair of ear portions 310 are located at the ends of the mask portion 300. The pair of ear portions 310 may be attached to the mask portion 300 or the article of clothing 30 may be of a substantially integral construction. Each of the pair of ear portions 310 is configured to fit over the external portion of the ear of the wearer as seen in FIGS. 11C, 11F and 11H. As shown, various embodiments of the pair of ear portions 310 may be constructed. For example, FIG. 11C, depicts a pair of ear portions 310 that are substantially shaped to the general form of external portion of the human ear. The pair of ear portions include a lobe portion 311, an upper ear portion 312 that extends from the upper periphery 301, and a curved posterior portion 313. FIG. 11F depicts a pair of ear portions 310 with a less pronounced "ear shape" relative to the embodiment depicted in FIG. 11C, but including a lobe portion 311 and a curved posterior portion 313. FIG. 11H depicts an embodiment of the pair of ear portions 310 where the lower periphery 302 extends to a substantially straight posterior portion 314 and a curved upper portion 315.

As depicted in FIGS. 13 and 14, each of the pair of ear portions 310 generally define a pocket to receive an ear of the wearer. The pair of ear portions 310 are intended to provide protection to the ears of the wearer from cold temperatures and/or wind. Each of the pair of ear portions 310 define an ear receiving region 320 and a helix wrap portion 321. The ear receiving region 320 is configured to receive at least a portion of the external surfaces of the ear. The helix wrap portion 321 is generally curved such that it extends around the helix of the ear and terminates behind the ear of the wearer. Thus, the helix wrap portion 321 may comprise a "C" shaped cross-section, with the helix of the ear of the wearer captured within. The helix wrap portion 321 may also extend downwardly to capture at least a portion of the lobule of the ear of the wearer. Accordingly, the article of clothing 30 is selectively securable to the wearer by locating the ears of the wearer in the pair of ear portions 310. The helix wrap portion 321 substantially maintains the location of the article of clothing 30 on the wearer and prevents inadvertent removal.

The article of clothing 30 may be constructed from a variety of materials, including materials typical of garments such as a sweater and accessory garments such as scarves, shawls and ear mufflers. In a particular embodiment, the article of clothing 30 is knit from yarn. For at least those embodiments configured to cover the mouth and nose and lacking the mouth opening 303 and/or the central portion 304, the mask portion 300 should be breathable to allow the wearer to readily inhale and exhale through the mask portion 300.

The article of clothing 30 may be constructed with a degree of elasticity such that the article may conform to a plurality of sizes of wearers, to conform to anatomical differences among wearers, and to facilitate retention of the article of clothing 30 on the wearer. For example, a degree of elasticity over the mask portion 300 serves to maintain the article of clothing 30 in its intended position on the wearer. The ear portion 310 may be constructed to have properties different from the mask portion 300. For example, the ear portion 310 may be of a denser construction to retain the shape of the ear portion and/or to provide greater thermal protection to the ears of the wearer. Additionally, the ear portion 310 may be of a construction that is configured to prevent the ear portion 310 from slipping off the ears of the wearer, yet possessing elasticity to substantially conform to the shape of the ear while being comfortable to promote wearability. In a particular embodiment the ear portion 310 may comprise a substantially rigid material. It may further be desirable to produce the article of clothing 30 in a plurality of sizes to accommodate wearers of a range of sizes.

FIGS. 15A-17B show a transformable glove 40 according to another embodiment of the present invention. The transformable glove 40 comprises a wrist portion 400, a hand portion 410 attached to the wrist portion 400, a thumb portion 420 coupled to the hand portion 410, a first finger portion 430 coupled to the hand portion 410 and a second finger portion 440 coupled to the hand portion 410. The transformable glove 40 further includes one or more openings located on the thumb portion 420, the first finger portion 430, and/or the third finger portion 440. The openings permit a wearer to selectively extend a thumb and/or one or more fingers outside of the transformable glove 40. Additionally, and as described in more detail below, the transformable glove 40 is configured to group the fingers of the wearer into a first finger group and a second finger group within the finger portions of the transformable glove 40. The transformable glove 40 may be constructed of materials typical used in gloves and mittens. In a particular embodiment, the transformable glove 40 is knit.

Figure 15A:
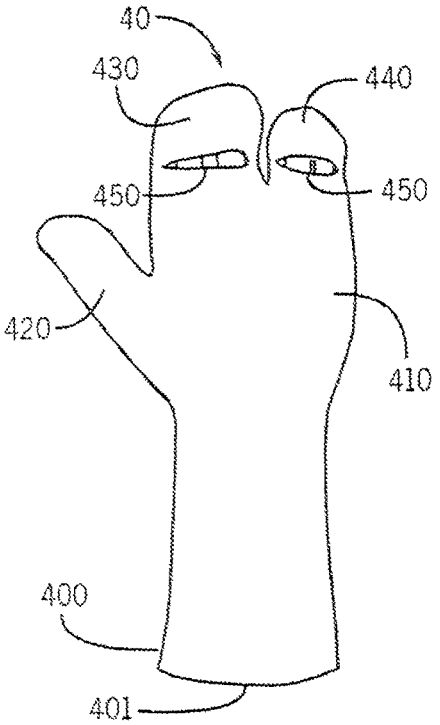
FIG. 15A is a front view of an embodiment of a left transformable glove worn in a first configuration constructed in accordance with an embodiment of the present invention.
Figure 15B:
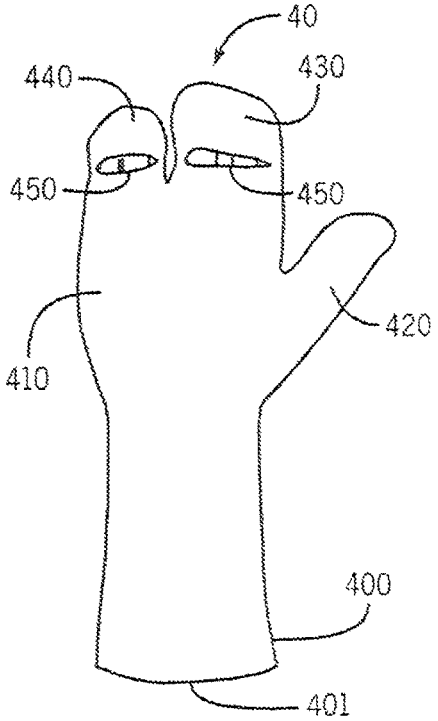
FIG. 15B is a front view of the right transformable glove worn in the first configuration according the embodiment of FIG. 15A.
Figure 16A:
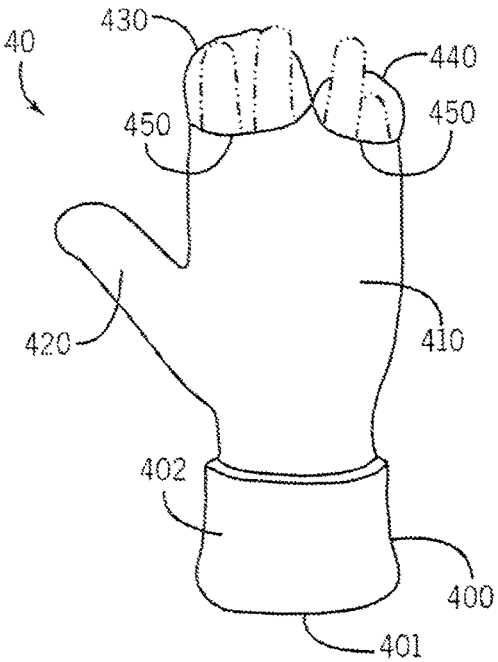
FIG. 16A is a front view of the left transformable glove of FIG. 15A worn in a second configuration.
Figure 17A:
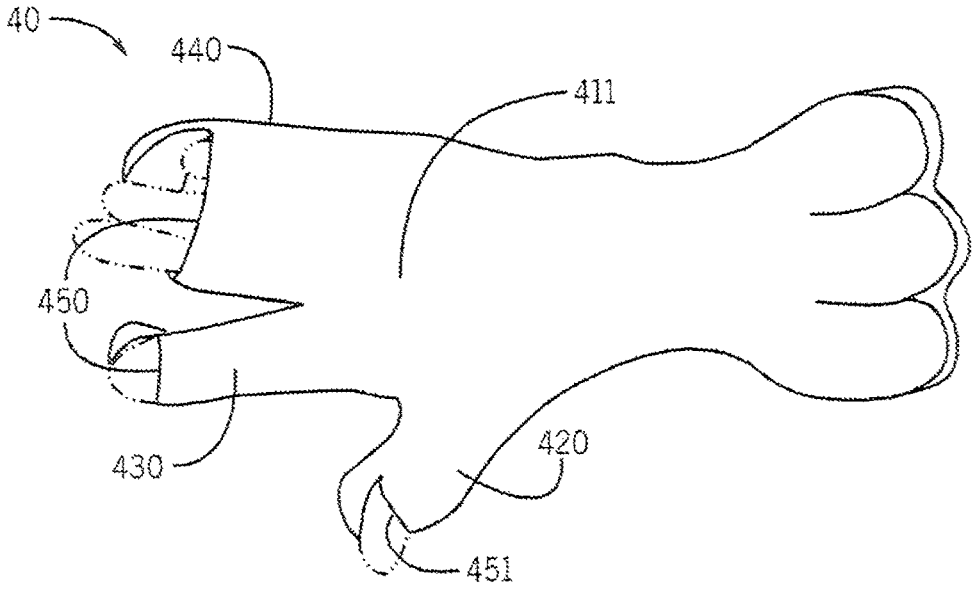
FIG. 17A is a front view of another embodiment of a left transformable glove worn in the second configuration constructed in accordance with an embodiment of the present invention.
Figure 17B:
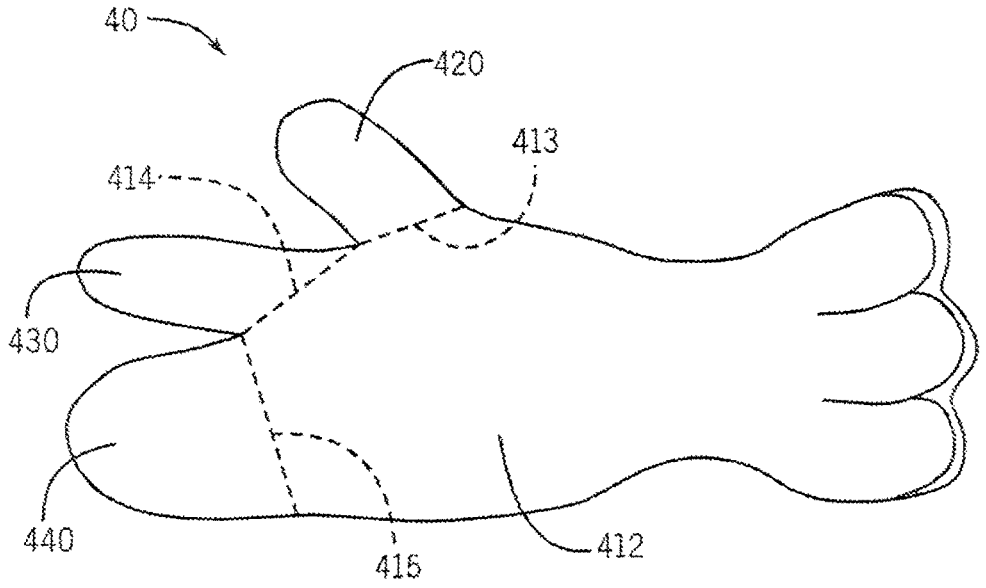
FIG. 17B is a rear view of the left transformable glove of FIG. 17A.

The wrist portion 400 includes an wrist opening 401 configured to receive the hand of the wearer and be worn about the wrist of the wearer. The wrist portion 400 may also include a selectively adjustable cuff 402. The selectively adjustable cuff 402 may be rolled upward as shown in FIG. 16A or rolled down as shown in FIG. 15A to adjust the length of the wrist portion 400. The hand portion 410 extends from the wrist portion 400 opposite the wrist opening 401. The hand portion 410 is configured to cover the hand of the wearer between the wrist and the thumb and fingers of the wearer. With reference to FIGS. 17A and 17B, the hand portion includes a palmal surface 411 and a dorsal surface 412 configured to respectively cover the palm and the dorsum of the hand of the wearer.

With reference to FIG. 17B the hand portion 410 may further include a thumb opening 413 located along a side of the hand portion 410, a first finger opening 414 and a second finger opening 415 located along the top of the hand portion 410. Each of the thumb opening 413, the first finger opening 414 and the second finger opening 415 are located on the hand portion 410 and sized to receive the respective digits of the wearer. A thumb portion 420 is attached to hand portion 410 at the thumb opening 413. The thumb portion 420 is configured to receive the thumb of the wearer. The first finger portion 430 is attached to hand portion 410 at the first finger opening 414. The third finger portion 440 is attached to hand portion 410 at the second finger opening 415.

In the embodiment of the transformable glove 40 depicted in FIGS. 15A-16B, the first finger portion 430 is configured to receive the first finger and the second finger (forefinger and middle finger) of the wearer. The second finger portion 440 is configured to receive the third finger and fourth finger (ring finger and little finger) of the wearer. As depicted, the first finger portion 430 and the second finger portion 440 each include a finger opening 450. The finger opening 450 may be disposed on the palmal side as shown or the dorsal side of the transformable glove 40. The finger opening 450 may be located anywhere along the length of the respective finger portion from base where the finger portion attaches to the hand portion 410 to a location proximate the tip of the finger portion. As shown, the finger opening 450 is located toward the tip of the respective finger portion proximate at least one of the distal interphalangeal joints of the finger of the wearer within the respective finger portion. Thus, the distal portion of one or more fingers in the respective finger portion may be selectively extended from the transformable glove 40 through the finger opening 450. The thumb portion 420 may also include a thumb opening (not shown) to permit at least a portion of the thumb of the wearer to be selectively extended outside the transformable glove 40.

Figure 16B:
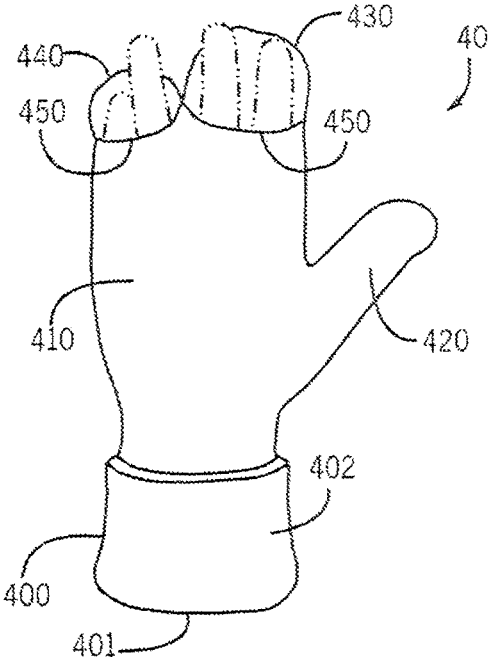
FIG. 16B is a front view of the right transformable glove of FIG. 15B worn in the second configuration.

In the embodiment of the transformable glove 40 depicted in FIGS. 16A and 16B, the first finger portion 430 is configured to receive the first finger (forefinger) of the wearer. The second finger portion 440 is configured to receive the second finger, the third finger and the fourth finger (middle finger, ring finger and little finger) of the wearer. As depicted, the first finger portion 430 and the second finger portion 440 each include a finger opening 450 and the thumb portion 420 includes a thumb opening 451. As previously described, the finger opening 450 and thumb opening 451 may be disposed on the palmal side as shown or the dorsal side of the transformable glove 40. The finger opening 450 and thumb opening 451 may be located anywhere along the length of the respective finger portion and the thumb portion 420, from the base where the respective finger/thumb portion attaches to the hand portion 410 to a location proximate the tip of the finger portion. As shown, the finger opening 450 of the first finger portion is proximate the distal interphalangeal joint of the first finger and the finger opening 450 of the second finger portion 440 is proximate the interphalangeal joint of the fourth finger of the wearer. Thus, the distal portion of one or more fingers in the respective finger portion may be selectively extended from the transformable glove 40 through the finger opening 450. Similarly, the tip of the thumb may also be extended outside the thumb portion 420 through the thumb opening 451.

Figure 18A:
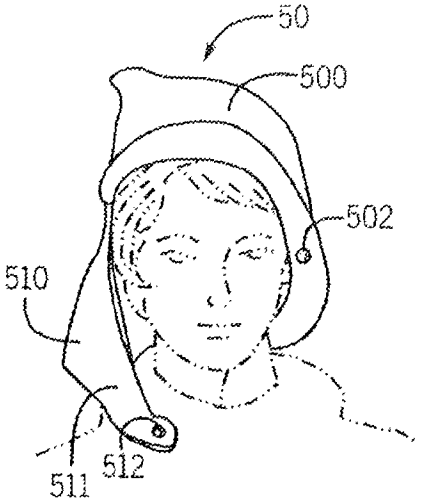
FIG. 18A is a front view of a transformable mask hat worn in a first configuration constructed in accordance with yet another embodiment of the present invention.
Figure 18B:
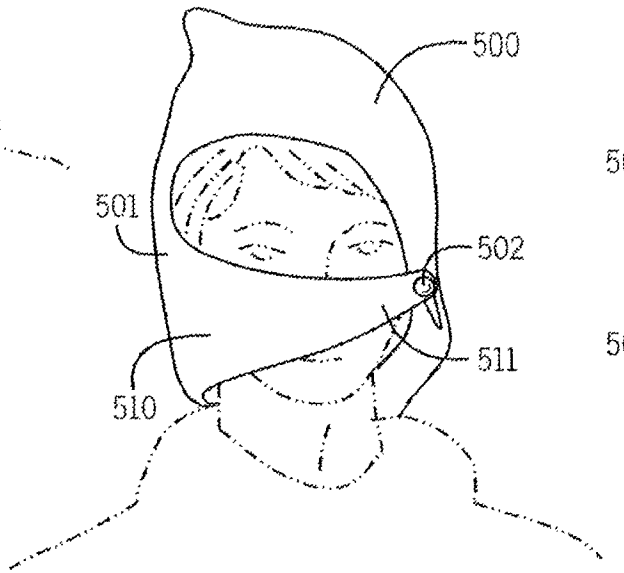
FIG. 18B is a front view of the transformable article of clothing of FIG. 18A worn in a second configuration.
Figure 18C:
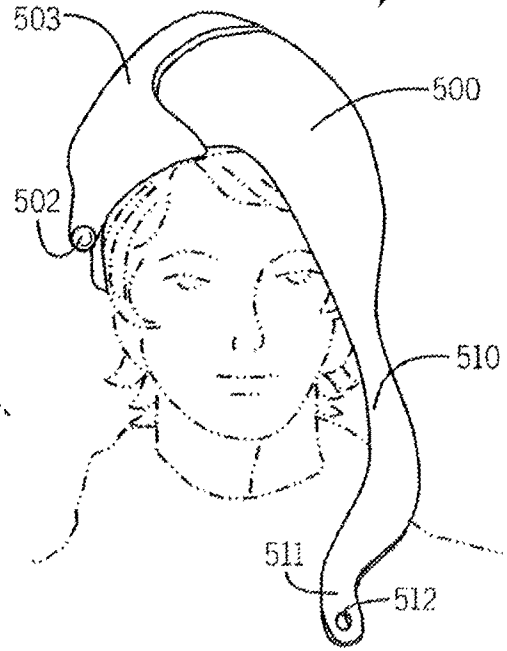
FIG. 18C is a front view of the transformable article of clothing of FIG. 6A worn in a third configuration.
Figure 19A:
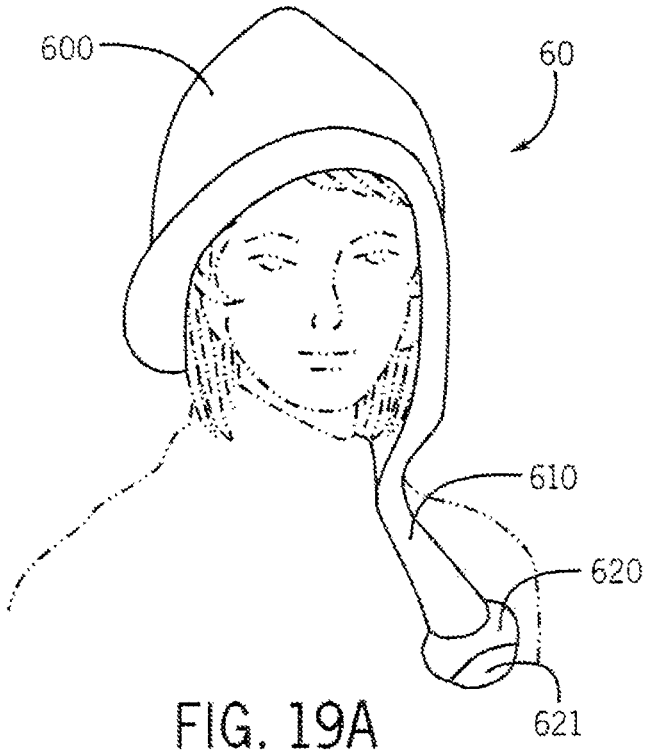
FIG. 19A is a first perspective view of a transformable hat and ear muffler worn in a first configuration constructed in accordance with another embodiment of the present invention.
Figure 19B:
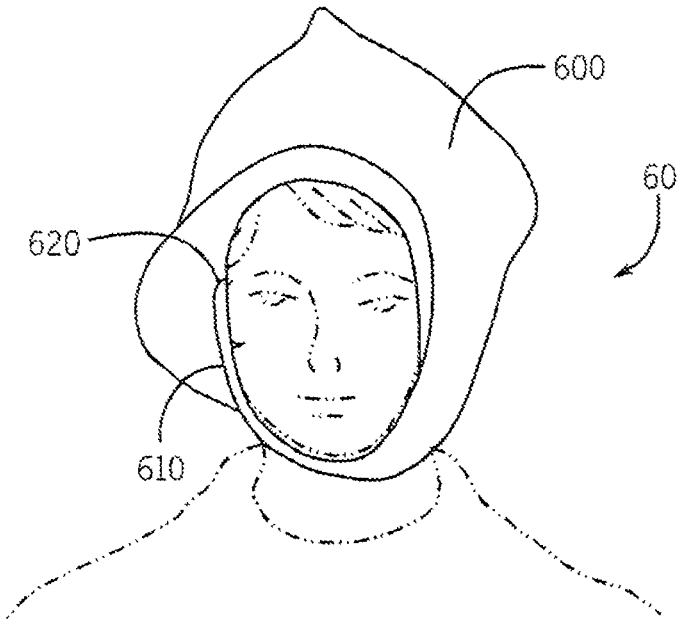
FIG. 19B is a second perspective view of the transformable hat and ear muffler of FIG. 19A worn in a second configuration.

FIGS. 18A-18C show a transformable mask hat 50 according to another embodiment of the present invention. The transformable mask hat 50 generally comprises a head receiving portion 500 and a mask portion 510 attached to a first location of the head receiving portion 500. The mask portion 510 is selectively attachable to a second location of the head receiving portion 500 substantially opposite the first location. The head receiving portion 500 is configured to receive at least a portion of the head of the wearer. The mask portion 510 is selectively orientatable by the wearer to a plurality of configurations. As shown in FIG. 18A, the mask portion 510 may be draped from the head receiving portion 500 and may cover a portion of the ear of the wearer. In FIG. 18B, the mask portion 510 traverses the face of the wearer and selectively attaches to head receiving portion 500 substantially opposite the origin of the mask portion 510. In yet another configuration, the mask portion 510 be positioned over a portion of the head receiving portion 500.

The head receiving portion 500 may comprise a generally domed hat structure sized to receive a portion of the head of the wearer. As best seen in FIG. 18B, the head receiving portion 500 may be asymmetrical and include a lateral portion 501 that extends downward from the head receiving portion 500. The lateral portion 501 is configured to cover one of the ears of the wearer and may cover a portion of the side of the face and/or head of the wearer. The head receiving portion 500 may further include a first mask engagement feature 502. The first mask engagement feature 502 can comprise any of variety of engagement elements, including a button, snap, latch, one portion of hook and loop fastener, or other feature. As depicted, the first mask engagement feature 502 comprises a ball. As best seen in FIG. 18C the head receiving portion 500 may also include a handle portion 503. The handle portion 503 includes a first end and a second end, each of which is attached to the head receiving portion 500 to form a carrying handle. The head receiving portion 500 may also include an opening (not shown). The opening may be disposed near the apex of the head receiving portion 500 and may be configured to permit a portion of the hair of the wearer to extend therethrough. In a particular embodiment, the handle portion 503 overlays the opening.

As shown, for example, in FIG. 18A, the mask portion 510 extends from a bottom periphery of the head receiving portion 500 from a location substantially opposite the first mask engagement feature 502 and terminates at a mask end 511. The mask portion 510 includes a second mask engagement feature 512. The second mask engagement feature 512 is located proximate the mask end 511 and is configured to selectively mate with the first mask engagement feature 502. In the depicted embodiment, the second mask engagement feature 512 comprises an opening configured to receive the ball defining the first mask engagement feature 502. It will be appreciated that the elements used as the first mask engagement feature 502 and the second mask engagement feature 512 may be reversed. That is, in the depicted embodiment, for example, the second mask engagement feature 512 may comprise a ball and the first mask engagement feature 502 may comprise an opening. The mask portion 510 may comprise a substantially triangular shape with the base of the triangle located where the mask portion 510 is attached to the head receiving portion 500 and the tip of the triangle proximate the mask end 511.

The mask portion 510 may be configured to cover the mouth and/or the nose of the wearer when attached to the first mask engagement feature as shown in FIG. 18B. The mask portion 510 may also be raised to extend over a portion of the head receiving portion 500 and coupled to the first mask engagement feature 502. In this configuration, the mask portion 510 may be passed beneath the handle portion 503. The transformable mask hat 50 may be constructed from materials typically used in the construction of hats and mufflers and in an embodiment is knit from yarn.

FIGS. 19A-21 show a transformable hat and ear muffler 60 according to another embodiment of the present invention. The transformable hat and ear muffler 60 generally comprises a head receiving portion 600 and an ear muffler portion 610 selectively attachable with an ear of the wearer. The ear muffler portion 610 is attached to the head receiving portion 600 near one of the ears of the wearer and extends to terminate in an ear attachment portion 620. In a first configuration depicted in FIG. 19A, the ear muffler portion 610 may be left to hang from the head receiving portion 600. In a second configuration depicted in FIG. 19B, the ear muffler portion 610 may pulled under the chin of the wearer and secured by engaging the ear attachment portion 620 with the other ear of the wearer.

Figure 20:
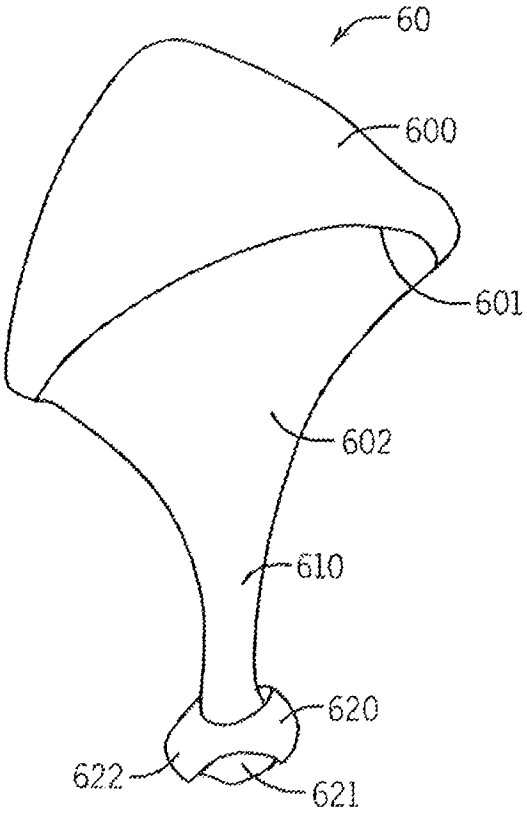
FIG. 20 is left side view of the transformable hat and ear muffler in the configuration shown in FIG. 19A.
Figure 21:
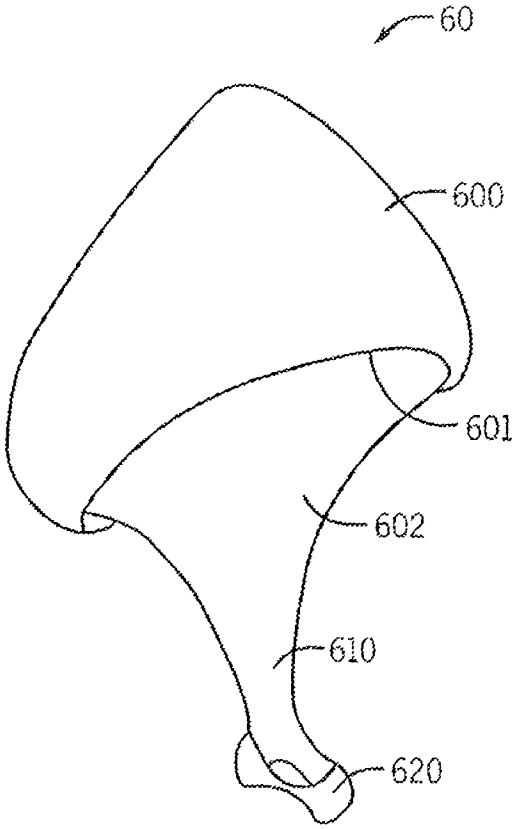
FIG. 21 is right side view of the transformable hat and ear muffler in the configuration shown in FIG. 19A.

With reference to FIGS. 20 and 21, the head receiving portion 600 may comprise a generally domed hat structure sized to receive a portion of the head of the wearer. The head receiving portion 600 defines a periphery 601. The head receiving portion 600 may be asymmetrical and include a lateral portion 602 that extends downward from the head receiving portion 600. The lateral portion 602 is configured to cover one of the ears of the wearer and may cover a portion of the side of the face and/or head of the wearer. The ear muffler portion 610 is attached to the lower edge of the lateral portion 602. As depicted, the ear muffler portion 610 comprises a rectangular strap. The ear attachment portion 620 is attached to the distal end of the ear muffler portion 610. The ear muffler portion 610 is of a length to allow the ear attachment portion 620 to engage the ear of the wearer opposite the lateral portion 602. The ear muffler portion 610 may comprise a material and/or weave that permits a degree of elasticity so that the transformable hat and ear muffler 60 may accommodate a plurality of wearers in a range of sizes.

The ear attachment portion 620 defines an ear pocket 621 intended to provide protection to the ear of the wearer from cold temperature and/or wind. The ear attachment portion is configured to selectively receive the outer portions of the ear of the wearer. The ear pocket 621 may be substantially shaped to the general form of the outside surfaces of the human ear and can include a curved periphery configured to extend around and behind a portion of the ear. The ear attachment portion 620 further includes an ear engagement member 622. The ear engagement member 622 comprises an anteriorly disposed strap that laterally traverses over the ear pocket 621. The ear engagement member 622 is configured to fit behind the external surface of the ear between the head and the ear of the wearer, thereby securing the ear attachment portion 620 in place on the ear of the wearer. Additionally, the ear attachment portion 620 provides thermal protection for the ear when engaged with the ear of the wearer. The transformable hat and ear muffler 60 may be constructed from a variety of materials, including materials typical of used in hats and ear mufflers. In a particular embodiment, the transformable hat and ear muffler 60 is knit from yarn.

FIGS. 22-24D show a transformable scarf 70 according to another embodiment of the present invention. The transformable scarf 70 comprises a first member 700 and a second member 710. The first member 700 is a generally rectangular piece of material having a first face 701 and a second face 702 opposite the first face 701. The first member 700 includes a plurality of openings 703 through the first face 701 and the second face 702. The plurality of openings 703 are disposed along a length and/or width of the first member 700. In the depicted embodiment, the plurality of openings 703 are disposed along a row across the length of the first member 700. A collar portion 704 may be disposed along a length of the first member. The collar portion 704 may comprises a different material, texture, color, and/or different material property from the first member 700. The collar portion 704 may include an arcuate periphery. In an embodiment, the first member 700 is arcuate.

Figure 22:
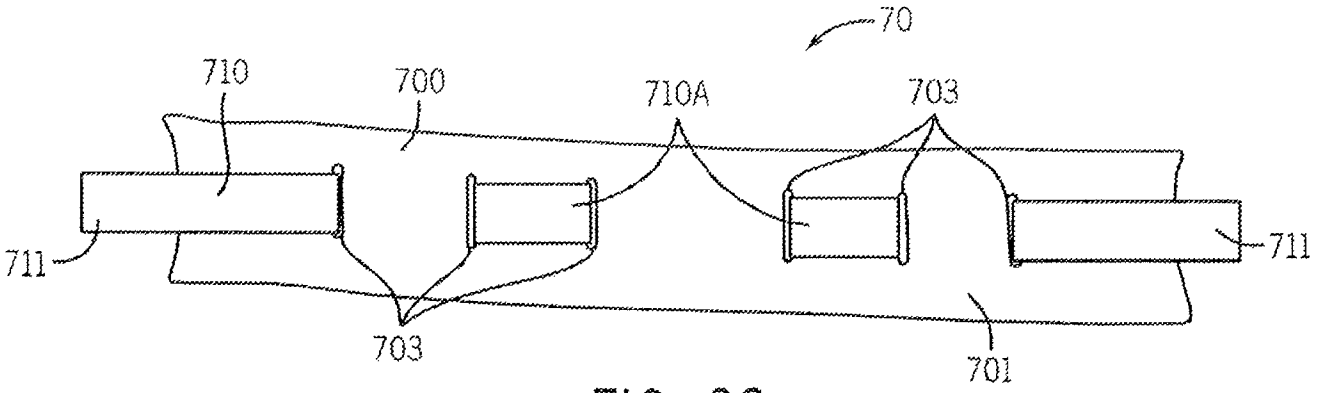
FIG. 22 is top view of a transformable scarf constructed according to still another embodiment of the present invention.
Figure 23:
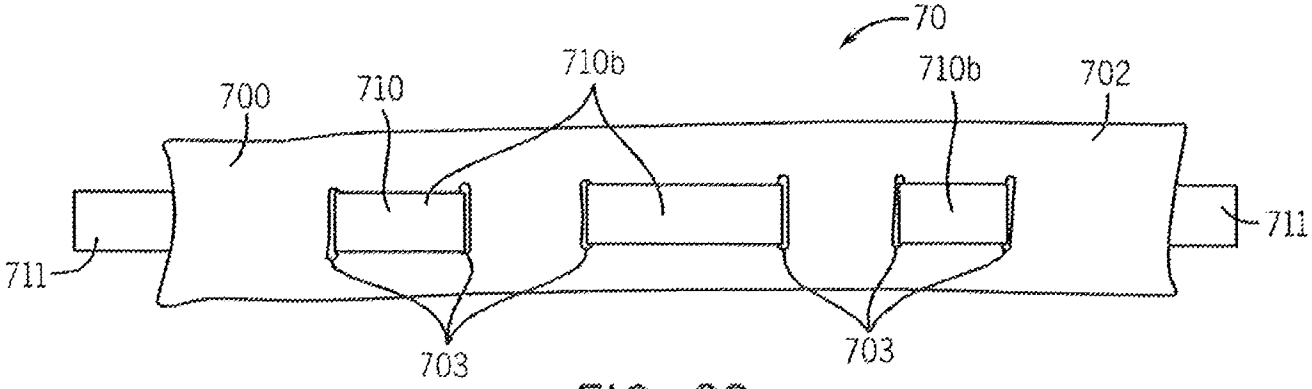
FIG. 23 is a bottom view of the transformable scarf of FIG. 22.
Figure 24D:
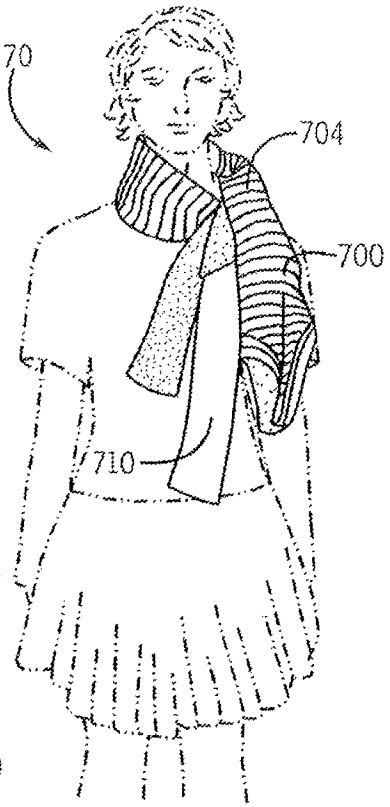
FIG. 24D is a front view of the transformable scarf of FIG. 22 worn in a fourth configuration.
Figure 24C:
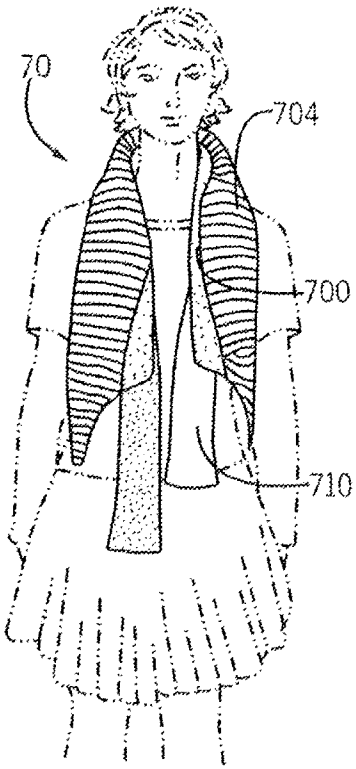
FIG. 24C is a front view of the transformable scarf of FIG. 22 worn in a third configuration.
Figure 24B:
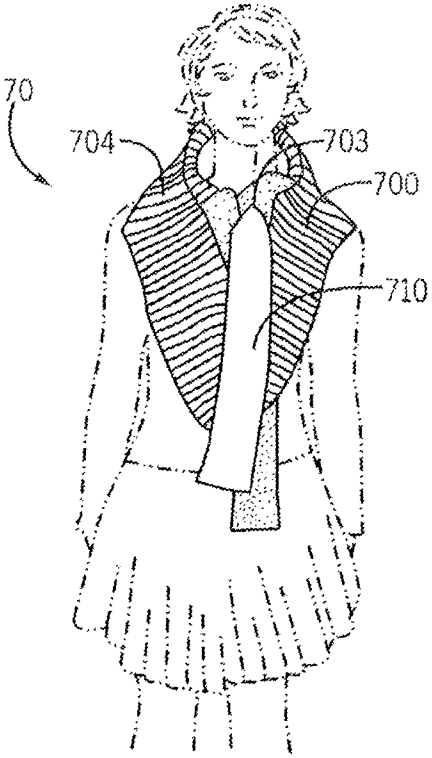
FIG. 24B is a front view of the transformable scarf of FIG. 22 worn in a second configuration.
Figure 24A:
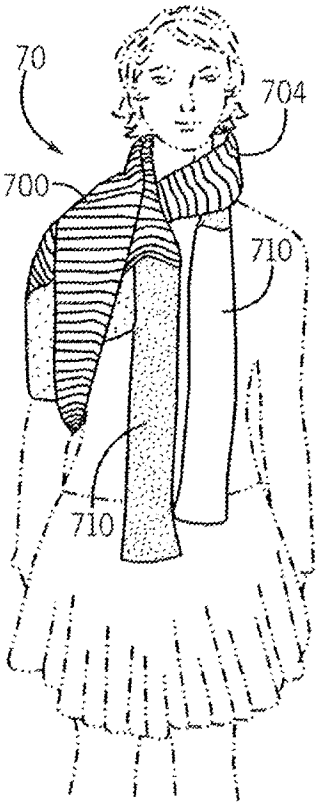
FIG. 24A a front view of the transformable scarf of FIG. 22 worn in a first configuration.

The second member 710 generally comprises an elongated piece of a material configured to pass through at least one of the plurality of openings 703. The second member 710 may be constructed of the same or different material relative to the first member 700. In a particular embodiment, the second member comprises a lightweight scarf. The second member 710 may be coupled to the first member 700 by selectively weaving the second member through the plurality of openings 703 between the first face 701 and the second face 702 as shown in FIGS. 22 and 23. As such, a portion of the second member 710*a* is disposed over the first face 701 and another portion of the second member 710*b* is disposed over the second face 702. The second member 710 may have a length greater than the first member 700 so that the ends 711 of the second member may extend beyond the first member 700. The ends 711 may be pulled and/or attached to each other or a portion of the first member to configure the transformable scarf 70 as desired by the wearer.

Figure 25A:
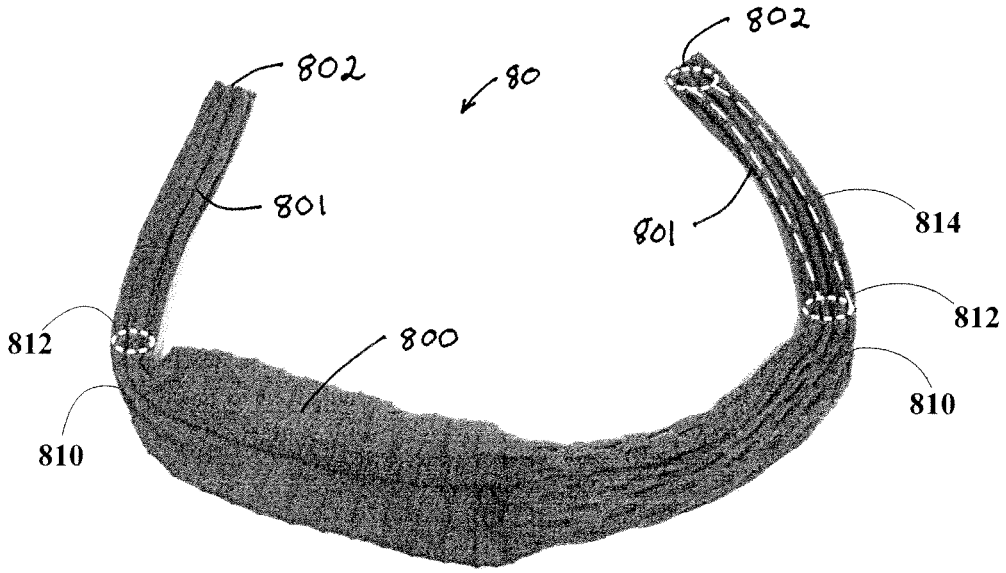
FIG. 25A is a rear view of a transformable article of clothing constructed according to another embodiment of the present invention.
Figure 25B:
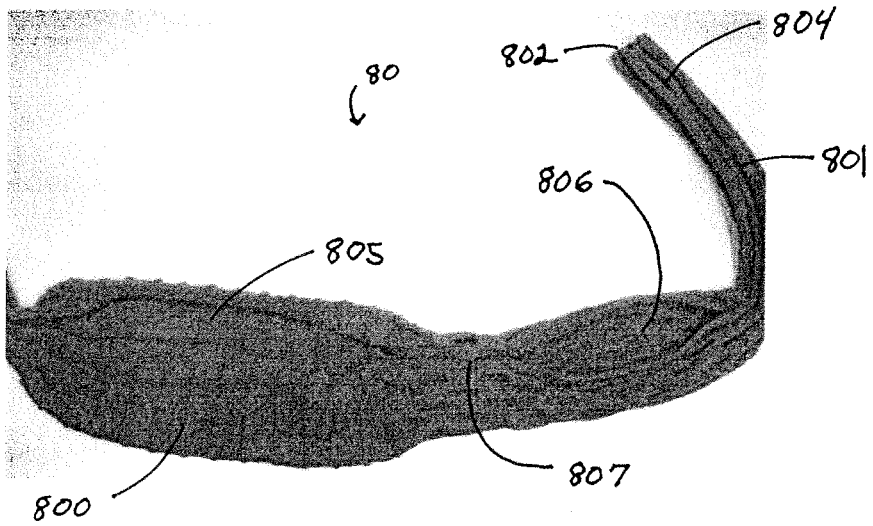
FIG. 25B is a partial front view of the transformable article of clothing of FIG. 25A.

FIGS. 25A-26C show a transformable article of clothing 80 according to another embodiment of the present invention. The transformable article of clothing 80 is configured such that it may be transformed into a plurality of configurations by the wearer, including a hat and scarf combination, a shoulder shrug and gloves combination, and an adjustable scarf. With reference to FIGS. 25A and 25B, the article of clothing 80 generally comprises a central portion 800 with an end portion 801 extending from opposite ends of the central portion 800. Each of the end portions 801 are substantially symmetrical and comprise tubular, sleeve-like components 814 configured to receive an arm or portion thereof of the wearer in certain configurations. When not occupied by the wearer's arm, the end portion 801 may be substantially flattened for wearing in other configurations.

The end portions 801 are open at each end opposite the central portion 800 and adjacent the central portion 800, having a distal opening 802 located at the end of the end portion 801 and a medial opening 812 in communication with the central portion 800 at a central portion end 810. The end portions 801 comprise a flexible fabric and, in various embodiments, may be knit and configured to stretch along their lengths to accommodate the various configurations and arm lengths of the wearer. A thumb hole 804 may further be located in each of the end portions 801 proximate the distal openings 802. The thumb hole 802 is generally located on the end portions 801 and sized to receive a thumb of the wearer and to permit extension of the wearer's thumb therethrough in certain configurations.

The central portion 800 may also comprise a generally elongated tubular structure defining an interior and having a longitudinal axis substantially aligned with the longitudinal axes of the end portions 801. In various configurations, a portion of the interior of the central portion 800 may be occupied by a portion of the wearer, including a portion of the head or arm/shoulder. The interior portion of the central portion 800 provides access to the end portions 801 through the respective medial openings 812. When the interior is not occupied, the central portion 800 may be substantially flattened such that the interior volume is greatly reduced. The central portion 800 comprises a flexible fabric and in various embodiments may be knit.

The central portion 800 is generally defined by at least one continuous or partially continuous surface but includes a first opening 805 and a second opening 806 through the surface providing communication to the interior of the central portion 800. The first opening 805 and the second opening 806 may comprise elongated openings that are substantially aligned and collinear in relation to their positions on the central portion 800. Alternatively, in various embodiments, the first opening 805 and the second opening 806 may be located in the central portion 800 such that they are opposing or offset. In various embodiments, the first opening 805 and the second opening 806 comprise slots or oblong lots slots where the width of the opening is less than the length. In certain embodiments, the first opening 805 is longer than the second opening 806 and may be about 50 percent longer in a particular embodiment. A bridge 807 may separate the first opening 805 and the second opening 806.

Figure 26C:
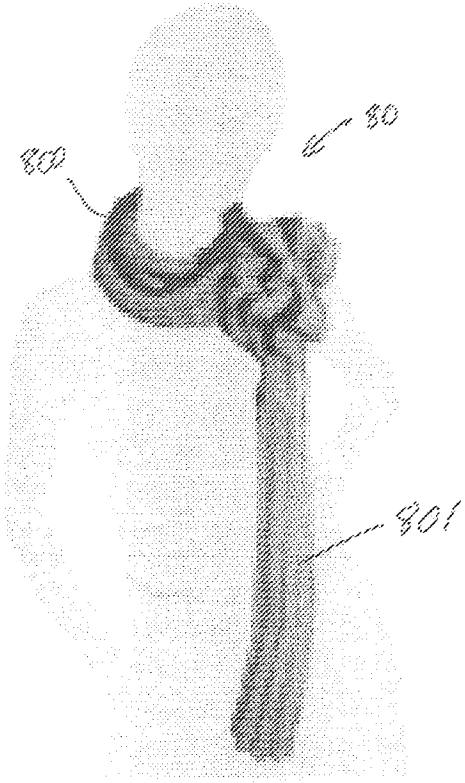
FIG. 26C is a front view of the transformable article of clothing of FIGS. 25A and 25B worn in a third configuration.
Figure 26B:
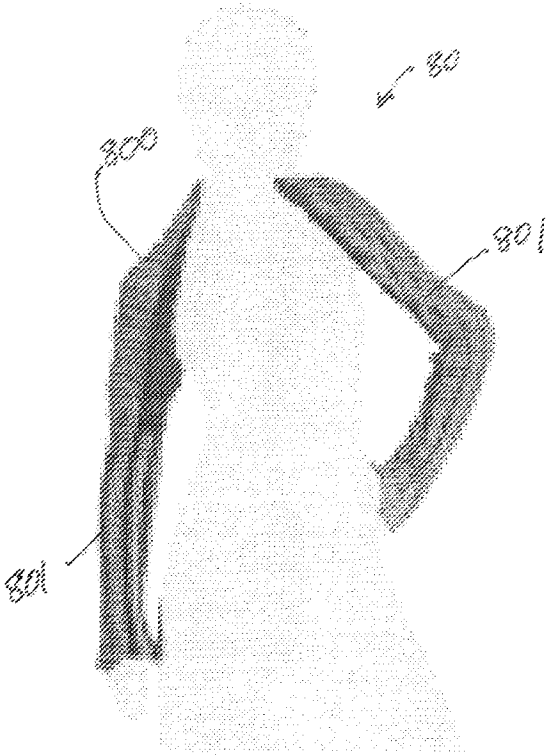
FIG. 26B is a front view of the transformable article of clothing of FIGS. 25A and 25B worn in a second configuration.
Figure 26A:
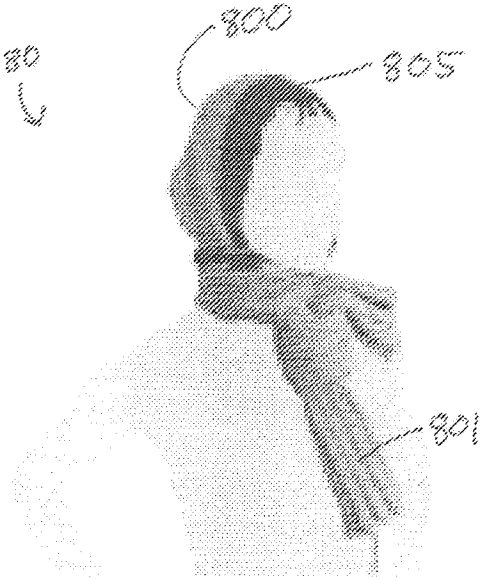
FIG. 26A is a front view of the transformable article clothing of FIGS. 25A and 25B worn in a first configuration.

Various configurations of the transformable article of clothing 80 are depicted in FIGS. 26A-26C. In a first configuration, providing for a combination hat and scarf depicted in FIG. 26A, the central portion 800 is placed on the wearer's head with the head extending through first opening 805 into the interior. The end portion 801 may be wrapped about the neck of the wearer in various orientations to provide a scarf. For example, the end portion 801 opposite the first opening 805 may be placed in or pulled through the distal opening 802 or the medial opening of the end portion 801 adjacent the first opening 805. Alternatively, the end portion 801 adjacent the first opening 805 may be placed in or pulled through the distal opening 802 or the medial opening of the end portion 801 opposite the first opening 805. In a second configuration, providing for a combination shoulder shrug and gloves depicted in FIG. 26B, the wearer's arms are placed in the respective end portions 801, entering through the first opening 805 and the second opening 806, respectively. The central portion 800 may be placed about the shoulders, back or waist of the wearer in this configuration. The wear's thumbs may be extended through the thumb holes 804. In a third configuration, providing for an adjustable scarf depicted in FIG. 26C, the transformable article of clothing 80 is wrapped about the neck of the wearer. One of the end portions 801 is pulled through the first opening 805 and the other end portion 801 is pushed up the end portion 801 that is pulled through the first opening 805. The end portions 801 may be moved relative to each other and/or the central portion 800 to select the length of the adjustable scarf.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described to explain the principles of the present invention and its practical application to enable one skilled in the art to utilize the present invention in various embodiments and with various modifications as are suited to the particular use contemplated.

What is claimed is:

1. A transformable article of clothing, comprising:

a central portion formed from a flexible material and comprising an elongated tube, the elongated tube extending from a first open end to a second open end, the elongated tube defining a first face and a second face, the central portion including a first lateral edge and a second lateral edge on the first face;

a first member coupled to an entire length of the central portion along the first lateral edge, the first member formed from a flexible material; and a second member coupled to the entire length of the central portion along the second lateral edge, the second member formed from a flexible material, wherein the central portion is reversible such that:

in a first position, the first face of the central portion forms an outer surface of the central portion, the first member extends from the outer surface, and the second member extends from the outer surface, thereby resulting in a shawl configuration wearable by a user, and in a second position, the first face of the central portion forms an inner surface of the central portion, and the first member and the second member are at least partially disposed within and partially disposed outside of the elongated tube, thereby resulting in a scarf configuration wearable by a user around the user's neck.

2. The transformable article of clothing of claim 1, wherein the second member is coupled to the central portion at a location substantially opposite the first member.

3. The transformable article of clothing of claim 1, wherein the first member comprises a first plurality of openings defining a plurality of fingers therebetween, and the second member comprises a second plurality of openings defining a second plurality of fingers therebetween, the second plurality of openings configured to substantially mate with the first plurality of fingers, the first plurality of openings configured to substantially mate with the second plurality of fingers.

4. The transformable article of clothing of claim 1, wherein the central portion is initially formed separately from the first member and the second member.

5. The transformable article of clothing of claim 1, wherein the central portion is initially formed as a single article from one of the first member and the second member.

6. The transformable article of clothing of claim 1, wherein the first member and the second member are initially formed as a single article, and wherein the central portion is formed from a combination of the single article and an additional member overlaid with the single article.

7. The transformable article of clothing of claim 1, wherein, when in the scarf configuration, the first member extends out of the first open end of the elongated tube, and the second member extends out of the second open end of the elongated tube.

8. The transformable article of clothing of claim 1, wherein an inner portion of the first member is overlapped with an inner portion of the second member.

9. The transformable article of clothing of claim 8, wherein the first member comprises a first edge that defines a periphery of the inner portion of the first member, the second member comprises a second edge defines a periphery of the inner portion of the second member.

10. The transformable article of clothing of claim 9, wherein the first member is attached to the second member proximate the first edge, and wherein the second member is attached to the first member proximate the second edge, such that the tubular member is formed with the inner portion of the first member and the inner portion of the second member each forming about one half of the outer surface of the central portion.

11. The transformable article of clothing of claim 1, wherein the first member is constructed of a first material, and wherein the second member is constructed of a second material, the first material possessing different thermal characteristics than the second material.

12. A transformable article of clothing, comprising:

a central portion formed from a flexible material and comprising an elongated tube, the elongated tube extending from a first end to a second end, the elongated tube defining a first face and a second face, the central portion including a first lateral edge and a second lateral edge on the first face;

a first member coupled to the central portion along the first lateral edge, the first member formed from a flexible material; and a second member coupled to the central portion along the second lateral edge, the second member formed from a flexible material, wherein the central portion is reversible such that:

in a first position, the first face of the central portion forms an outer surface of the central portion, the first member extends from the outer surface, and the second member extends from the outer surface, thereby resulting in a shawl configuration wearable by a user, and in a second position, the first face of the central portion forms an inner surface of the central portion, and the first member and the second member are at least partially disposed within the elongated tube, thereby resulting in a scarf configuration wearable by a user around the user's neck wherein the first member comprises a first plurality of openings defining a plurality of fingers therebetween, and the second member comprises a second plurality of openings defining a second plurality of fingers therebetween, the second plurality of openings configured to substantially mate with the first plurality of fingers, the first plurality of openings configured to substantially mate with the second plurality of fingers.

13. A transformable article of clothing, comprising:

a central portion formed from a flexible material and comprising an elongated tube, the elongated tube extending from a first end to a second end, the elongated tube defining a first face and a second face, the central portion including a first lateral edge and a second lateral edge on the first face;

a first member coupled to the central portion along the first lateral edge, the first member formed from a flexible material; and a second member coupled to the central portion along the second lateral edge, the second member formed from a flexible material, wherein the central portion is reversible such that:

in a first position, the first face of the central portion forms an outer surface of the central portion, the first member extends from the outer surface, and the second member extends from the outer surface, thereby resulting in a shawl configuration wearable by a user, and in a second position, the first face of the central portion forms an inner surface of the central portion, and the first member and the second member are at least partially disposed within the elongated tube, thereby resulting in a scarf configuration wearable by a user around the user's neck, wherein, when in the scarf configuration, the first member extends out of the first end of the elongated tube, and the second member extends out of the second end of the elongated tube.

14. A transformable article of clothing, comprising:

a central portion formed from a flexible material and comprising an elongated tube, the elongated tube extending from a first end to a second end, the elongated tube defining a first face and a second face, the central portion including a first lateral edge and a second lateral edge on the first face;

a first member coupled to the central portion along the first lateral edge, the first member formed from a flexible material, the first member constructed of a first material; and a second member coupled to the central portion along the second lateral edge, the second member formed from a flexible material, the second member constructed of a second material, the first material possessing different thermal characteristics than the second material, wherein the central portion is reversible such that:

in a first position, the first face of the central portion forms an outer surface of the central portion, the first member extends from the outer surface, and the second member extends from the outer surface, thereby resulting in a shawl configuration wearable by a user, and in a second position, the first face of the central portion forms an inner surface of the central portion, and the first member and the second member are at least partially disposed within the elongated tube, thereby resulting in a scarf configuration wearable by a user around the user's neck.

* * * * *